US010265606B1

(12) United States Patent
Chung

(10) Patent No.: US 10,265,606 B1
(45) Date of Patent: Apr. 23, 2019

(54) SKATEBOARD ASSEMBLY AND TRUCK ASSEMBLY WITH FLOATING KINGPIN

(71) Applicant: Rasyad Chung, Berkeley, CA (US)

(72) Inventor: Rasyad Chung, Berkeley, CA (US)

( * ) Notice: Subject to any disclaimer, the term of this patent is extended or adjusted under 35 U.S.C. 154(b) by 0 days.

(21) Appl. No.: 16/158,696

(22) Filed: Oct. 12, 2018

Related U.S. Application Data

(60) Provisional application No. 62/572,185, filed on Oct. 13, 2017.

(51) Int. Cl.
*A63C 17/00* (2006.01)
*A63C 17/01* (2006.01)

(52) U.S. Cl.
CPC ..... *A63C 17/0046* (2013.01); *A63C 17/0093* (2013.01); *A63C 17/012* (2013.01); *A63C 17/015* (2013.01)

(58) Field of Classification Search
CPC ..... A63C 17/00; A63C 17/01; A63C 17/012; A63C 17/015
See application file for complete search history.

(56) References Cited

U.S. PATENT DOCUMENTS 4,109,925 A * 8/1978 Williams ..... A63C 17/01 280/11.28
5,165,710 A 11/1992 Runyon
6,182,987 B1 2/2001 Bryant
6,224,076 B1 5/2001 Kent
6,474,666 B1 11/2002 Andersen et al.
6,520,517 B1 2/2003 Chung et al.
6,793,224 B2 9/2004 Stratton
7,104,558 B1 2/2006 Saldana
7,044,485 B2 5/2006 Kent et al.
8,579,300 B2 * 11/2013 Fraley ..... A63C 17/012 280/11.28
9,145,030 B2 * 9/2015 Williams ..... B60B 35/025
9,821,215 B2 * 11/2017 Ivazes ..... A63C 17/0046
9,901,807 B2 2/2018 Su
2004/0145142 A1 7/2004 Wang
2005/0167938 A1 8/2005 Chung
2009/0273152 A1 11/2009 Chung
2011/0316245 A1 12/2011 Burke
2014/0027989 A1 1/2014 Baumann

* cited by examiner

*Primary Examiner* — James A Shriver, II
*Assistant Examiner* — James J Triggs
(74) *Attorney, Agent, or Firm* — Adams Law Office; Sharon Adams

(57) ABSTRACT

A truck and a skateboard assembly comprised of two trucks and a deck. The truck of the present invention has three rigid bodies and two degrees of freedom. The three rigid bodies comprise: (1) the deck and baseplate assembly for the skateboard assembly, or the baseplate assembly for the truck; (2) the hanger assembly; and (3) the floating kingpin assembly. The three rigid bodies are joined together by three spherical joints and elastomerically coupled and constrained by elastomeric components. The truck of the present invention provides the combined functionality of deep deck lean, improved steering control over a wider range of speed, improved speed stability, and improved suspension compared to existing skateboard trucks.

14 Claims, 28 Drawing Sheets

FIG. 9
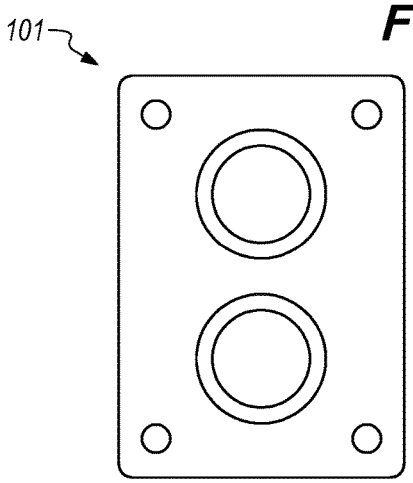
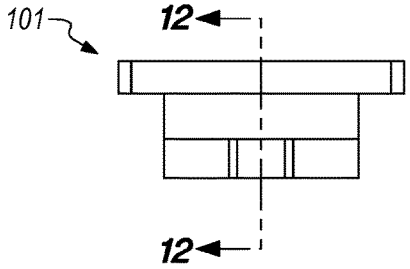
FIG. 10
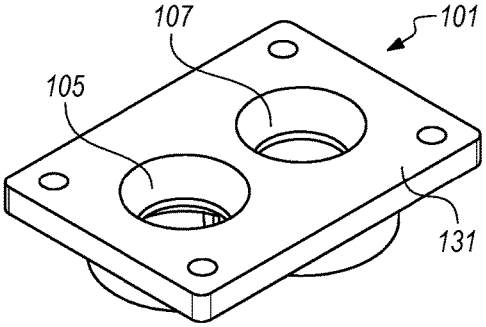
FIG. 11
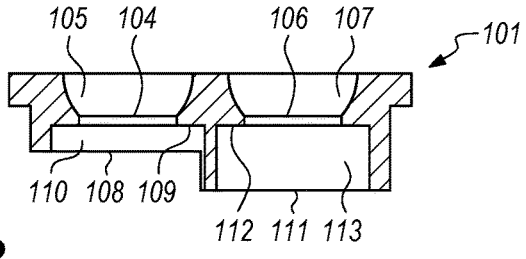
FIG. 12

SKATEBOARD ASSEMBLY AND TRUCK ASSEMBLY WITH FLOATING KINGPIN

CROSS REFERENCE TO RELATED APPLICATION

This application claims the benefit of U.S. provisional patent application No. 62/572,185 filed on Oct. 13, 2017, which is hereby incorporated by reference in its entirety.

BACKGROUND OF THE INVENTION

Since the early 1960s there has been a strong connection between surfing and skateboarding that has influenced the history of skateboard design as well as the larger culture of board sports. Terms like "sidewalk surfing" and "surfing-like ride and feel" speak to this connection and have been used to describe ways skateboards attempt to mimic the sensations and ride dynamics of surfing.

Surfing, and other board sports share common ride dynamics of deep deck lean, stability at speed and the ability to "carve" turns.

"Carving" is the ability to make turns and control speed and is associated with deep deck lean and a feeling of "sinking into" the turn such that the deeper the deck or board is leaned the stronger the carving sensations. Carving turns typically involves higher speed and higher turn forces that must be matched by rider input, commitment, and advanced skill. With carving there is also a weightless, floating sensation experienced in the transition between linked turns.

The lean-steering mechanism of skateboards, skates and the like is commonly referred to as the "truck-assembly", or simply a "truck". A skateboard truck typically comprises two rigid bodies: a baseplate mounted to a deck and a hanger that supports two laterally spaced wheels that roll on the ground. The rigid bodies of baseplate and hanger are kinematically linked so as to allow rotation relative to each other about a common axis defined by the geometry of the baseplate called here the "hanger pivot axis".

A skateboard typically comprises a deck upon which the rider stands and a pair of trucks symmetrically mounted to each end of the deck. When constrained by the plane of the ground, a rider standing on the deck leans the deck right to steer right and left to steer left.

Existing skateboard trucks known as fixed king pin trucks consist of mechanisms with two rigid bodies. The present invention introduces a new class of skateboard truck with three rigid bodies, two degrees of freedom, and three primary motions which provide deep deck lean, improved steering control, improved stability at speed, and improved suspension. By delivering this combination of functional attributes the present invention is thus of great use to skateboard riders in search of a more powerful surfing-like ride feel.

Fixed Kingpin Trucks—Kinematic Description (Description of Movement).

Fixed kingpin trucks are a class of trucks that utilize two rigid bodies: (1) a baseplate with a fixed kingpin, PA1; and (2) a hanger with an axle PA2 that supports—a pair of laterally spaced wheels that roll on the ground. With fixed kingpin trucks the baseplate and hanger are connected and constrained by two semi-spherical joints PA11 and PA12 that together allow a single degree of freedom relative to each other, namely rotation about a common axis PA14 called here the "hanger pivot axis".

The baseplate of a fixed kingpin truck is a first rigid body with a hemispheric recess PA108 called a pivot cup that receives the end of the pivot arm PA201 of the hanger to form a first semi-spherical joint PA11. The baseplate also has a kingpin PA300 that extends downward at an inclined angle. The kingpin is typically fixed to the baseplate by press fit, threaded, or bolted connections, and therefore functions as a single rigid body with the baseplate.

The second rigid body is the hanger PA2 with a pivot arm PA201 that is received within the hemispheric recess PA108 of the baseplate PA1. The hanger also has a centrally positioned, ring shaped yoke PA202 that receives the fixed kingpin PA300 of the baseplate. When assembled the ring shaped yoke of the hanger is sandwiched between elastomeric bushings PA350 and PA351 to form a second semi-spherical elastomerically constrained joint PA12. The elastomeric bushings are integral to truck assembly and provide a return-to-center force.

Hanger axle members support a pair of laterally spaced wheels. Assembly is typically completed by tightening the kingpin nut PA307 to preload the elastomeric bushings PA350 and PA351 and constrain the yoke surfaces of the hanger with the fixed kingpin PA300. Tightening the kingpin nut also constrains the first semi-spherical joint PA11 of the baseplate pivot cup PA108 and hanger pivot arm PA201 from coming apart.

A "hanger pivot plane" PA10 is a central longitudinal plane of the baseplate perpendicular to the mounting surface of the baseplate with the deck and coincident with the axis of the fixed kingpin. With fixed kingpin trucks the hanger pivot plane remains perpendicular to the baseplate and coincident with the centroid point of the first and second semi-spherical joints.

With fixed kingpin trucks the "hanger pivot axis" PA14 is a single axis of rotation between the rigid bodies of baseplate and hanger. The hanger pivot axis is defined by the centroid points of the first and second semi-spherical joints and is coincident with the hanger pivot plane.

A "hanger pivot axis angle" PA19 is defined by the inclined angle of the hanger pivot axis relative to the top surface of the baseplate that supports the skateboard deck.

A "virtual pivot point" PA16 is located at the intersection of the hanger pivot axis PA14 and a line PA21 vertically projected from the center of the hanger axle axis. The assembly of a skateboard with two fixed kingpin trucks creates a single deck roll axis called here the "virtual pivot point roll axis" PA17 that is defined by the virtual pivot points of the front and rear trucks.

Fixed Kingpin—Kinetic Description (Description of Forces that Cause Motion).

In use a rider stands on the deck of an assembled skateboard and the wheels are constrained by the plane of the ground. On a skateboard with fixed kingpin trucks rider input to lean the deck directly causes the rotation of the deck and baseplates and hanger pivot plane to rotate about the virtual pivot point roll axis and the hangers to rotate about the hanger pivot axis of the each truck resulting in the classic lean-steering response of the wheels on the ground. Springs or elastomeric components provide a return to center force.

Fixed Kingpin Trucks—Ride Dynamics.

Fixed kingpin trucks typically have a limited range of adjustment which is not ideal because the firmness of the elastomeric bushing and preload adjustment must match both rider weight and specific style of riding. As well, fixed kingpin trucks with bushings that are too soft for rider weight, are worn, or are too loosely adjusted become unstable at higher speeds. Consequently riders must carefully choose between bushing durometer and preload adjustments that favor deeper deck lean and turning at slower speed or limited deck lean and greater stability at higher speed.

Design and geometry of fixed kingpin trucks have become specialized and optimized for specific speed ranges requiring riders to choose between (1) fixed kingpin trucks optimized for deeper deck lean and tighter turning at slower speed but lack stability at higher speed, or (2) fixed kingpin trucks optimized for stability at higher speed that consequently have a limited range of deck lean and do not turn well at slower speed.

With this specialization, skateboards with fixed kingpin trucks are not able to deliver the combined functionality of deep deck lean, turning, and stability across all speed ranges.

BRIEF SUMMARY OF THE INVENTION

The present invention comprises a truck assembly, and further comprises a skateboard assembly comprised of two trucks and a deck. The truck assembly may be used with a skateboard, or with any riding device with a deck, as a non-limiting example scooters. The skateboard and truck of the present invention provides the combined functionality of deep deck lean, improved steering control over a wider range of speed, improved speed stability, and improved suspension compared to existing skateboard trucks.

As shown in FIGS. 2 through 7, a truck of the present invention has three rigid bodies and two degrees of freedom.

For the truck, the three rigid bodies comprise the: (1) baseplate assembly/rigid body 1; (2) hanger assembly/rigid body 2; and (3) floating kingpin assembly/rigid body 3. For the skateboard assembly, the three rigid bodies comprise the deck and baseplate assembly/rigid body 1; (2) hanger assembly/rigid body 2; and (3) floating kingpin assembly/rigid body 3. In a preferred embodiment, the three rigid bodies are joined together by three spherical joints 11, 12, and 13 and, elastomerically coupled and constrained by floating kingpin elastomeric components 220*a* and pivot arm elastomeric component 220*b*.

In contrast with fixed kingpin trucks the hanger pivot plane 10 of the present invention is defined by the centroid points of the three spherical joints 11, 12, and 13. Consequently with the present invention the hanger pivot plane 10, hanger pivot axis 14 and floating kingpin assembly/rigid body 3 are kinematically linked and move together. Although the hanger pivot plane 10 and hanger pivot axis 14 are not physical bodies, both move with the floating kingpin assembly and function as a single rigid body.

A first degree of freedom is rotation around the hanger pivot axis 14 defined by the centroid points of second spherical joint 11 and third spherical joint 13. With the present invention deck and baseplate assembly/rigid body 1, floating kingpin/rigid body 3, and hanger pivot plane 10 rotate about hanger pivot axis 14 relative to hanger assembly/rigid body 2.

A second degree of freedom, unique to the present invention, is the longitudinal roll axis 18 defined by the centroid points of second spherical joint 11 and first spherical joint 12. With the present invention rider input causes deck and baseplate assembly/rigid body 1 to rotate about longitudinal roll axis 18 relative to floating kingpin assembly/rigid body 3, the hanger pivot plane, and hanger assembly/rigid body 2.

As explained above, existing skateboard trucks have two rigid bodies and one degree of freedom, rotation about the hanger pivot axis. When pre-existing trucks are connected with a skateboard and a user is riding the skateboard, the truck/skateboard assembly has two primary motions: leaning, and steering. These two motions are linked and are frequently referred to as "lean-steering".

When the trucks of the present invention are connected with a skateboard, and a rider is using the skateboard, the truck/skateboard assembly has three primary motions, leaning, steering, and floating.

Conventional skateboards with fixed kingpin trucks have a lean-steering response such that in use rider input leaning the deck directly leans the hanger pivot plane, the hanger pivot axis, the fixed kingpin, and the elastomeric bushings as a single unit. With the wheels constrained by the plane of the ground steering results as first rigid body PA1 and second rigid body PA2 rotate relative to each other about hanger pivot axis PA14. In contrast, skateboards with trucks of the present invention utilize elastomeric components to couple the motions of leaning and steering. In use, rider input to lean the deck compresses the elastomeric components which then transfer torque between the three rigid bodies and by so doing couple the motions of leaning and steering that would otherwise be independent given the kinematic relationship of the three rigid bodies and three spherical joints.

A skateboard assembly of the present invention comprises a skateboard deck with two ends, and with one truck of the present invention at each end of the deck. The skateboard assembly, when in use and with the wheels constrained by the ground, creates three primary motions of leaning, steering, and floating. When in use, the first primary motion of leaning is a combination of rotations of baseplate and deck assembly/rigid body 1 about longitudinal roll axis 18 and rotation of the baseplate and deck assembly/rigid body 1 and hanger pivot plane 10 about virtual pivot point roll axis 17. The second primary motion of steering is rotation of hanger assembly/rigid body 2 about hanger pivot axis 14. The third primary motion of float is a range of independence between the motions of steering and leaning such that within limits defined by the range of motions of spherical joints 11, 12, and 13 and the elastomeric constraints of elastomeric components a range of leaning is possible without steering and a range of steering is possible without leaning, and thus the skateboard is less subject to other inputs like road vibration and lateral forces.

With a skateboard of the present invention a new motion of floating is introduced that creates an adjustable range of independence between the motions of leaning and steering. The skateboard of the present invention allows riders to experience a surf-like feel while skateboarding, and has greater stability at a wider range of speeds.

BRIEF DESCRIPTION OF THE DRAWINGS OF THE PRESENT INVENTION

FIG. 9 shows a top view of baseplate.

FIG. 10 shows a front view of baseplate.

FIG. 11 shows a top perspective view of baseplate.

FIG. 12 shows a side sectional view of baseplate.

DETAILED DESCRIPTION OF THE INVENTION

Kinematic Description—Three Rigid Bodies

Figure 1:
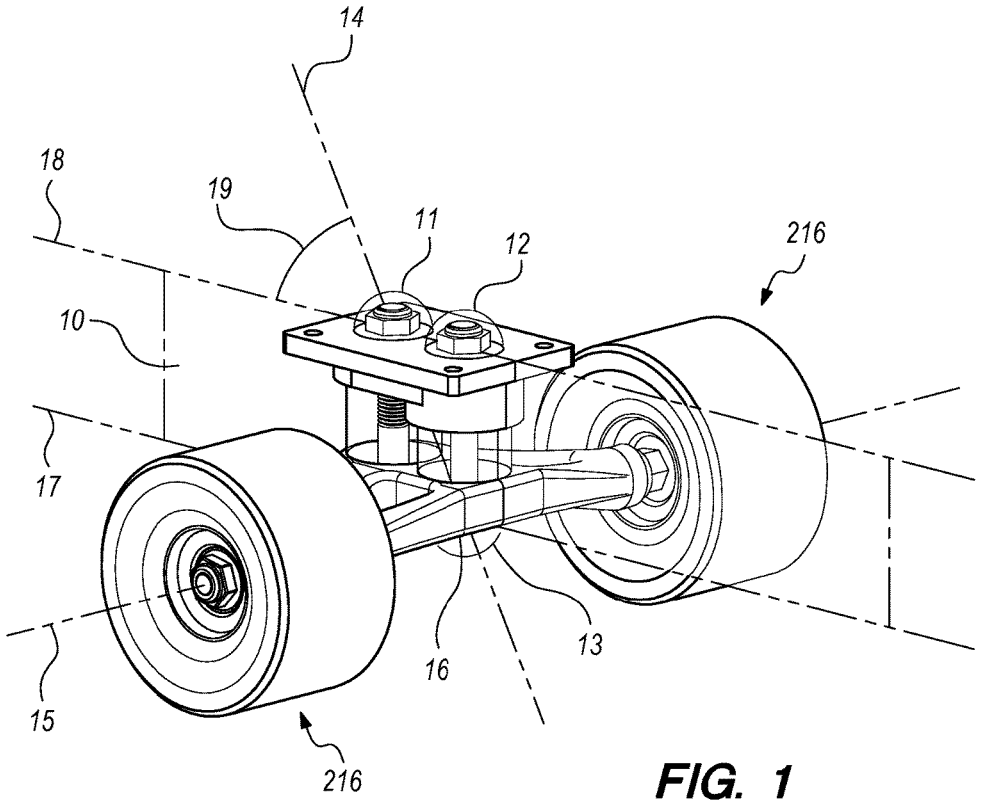
FIG. 1 shows a perspective assembled view of current invention showing hanger pivot plane, axes of rotation, and three spherical joints.
Figure 2:
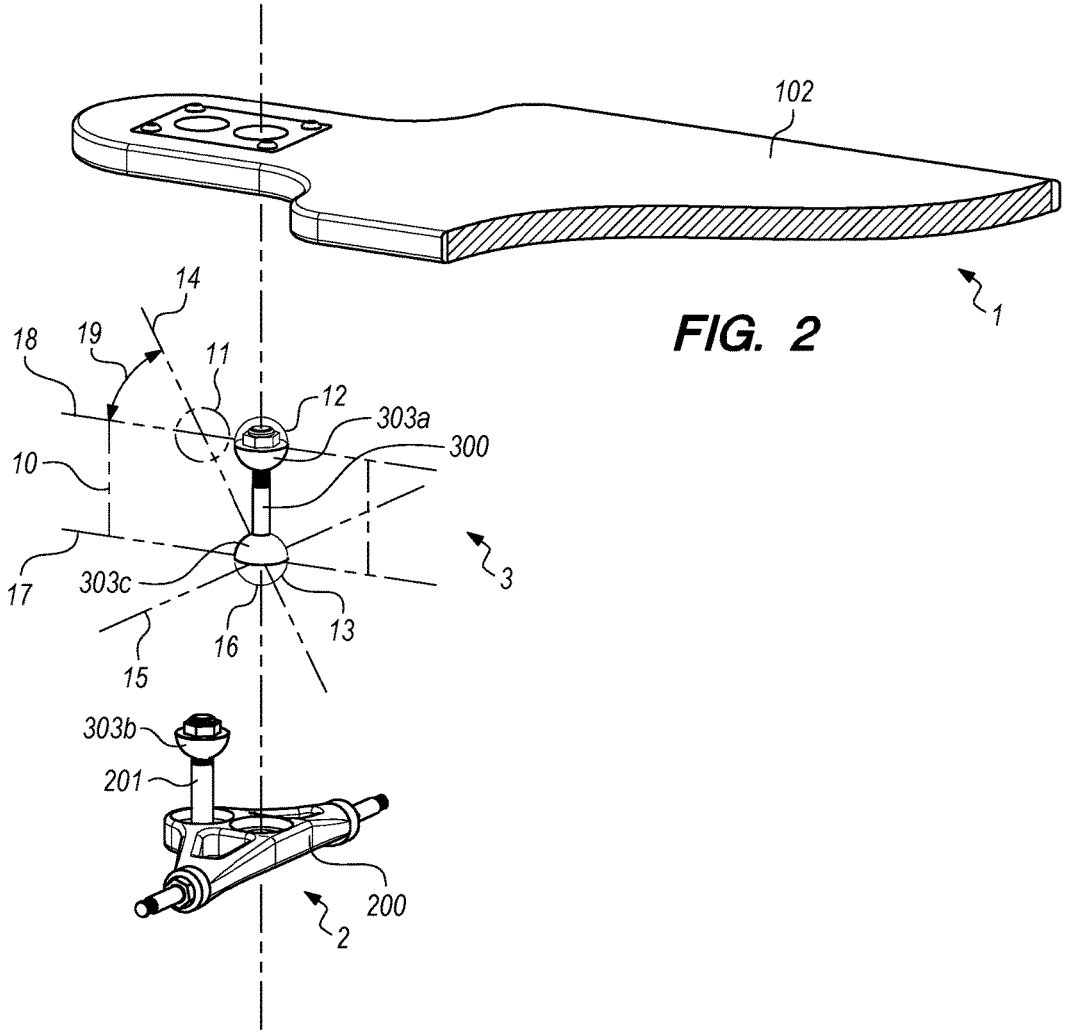
FIG. 2 shows an exploded view of current invention showing the three rigid bodies, and the hanger pivot plane with three axes of rotation, and three spherical joints.
Figure 3:
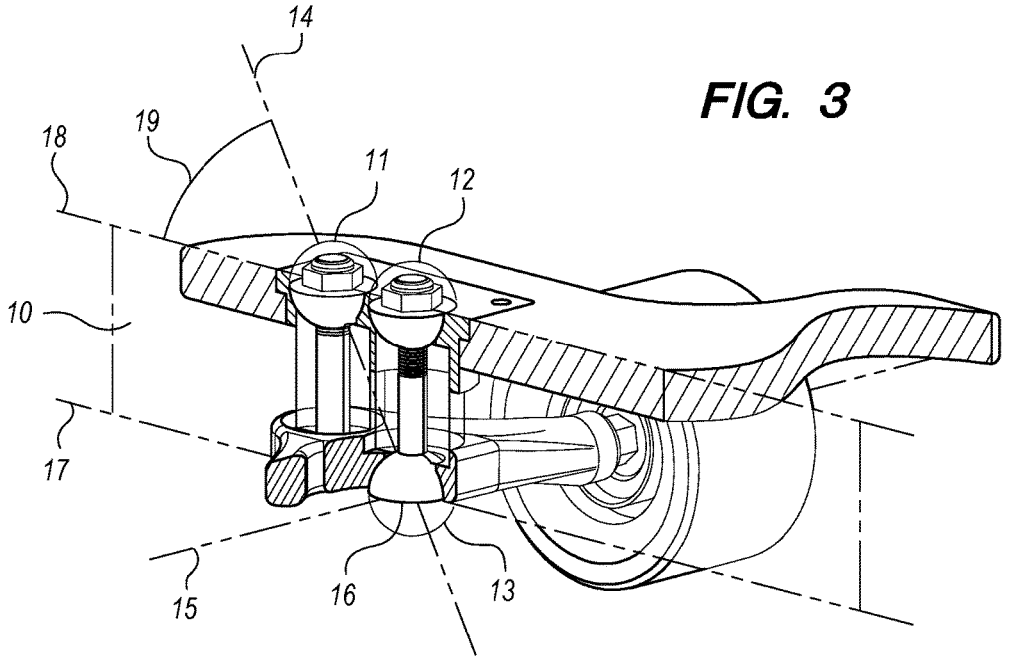
FIG. 3 shows a partial side section view of present invention.
Figure 4:
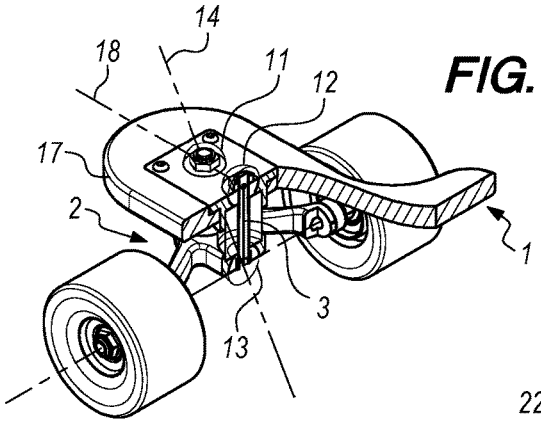
FIG. 4 shows a rear perspective sectional view with no deck lean or steering.
Figure 5:
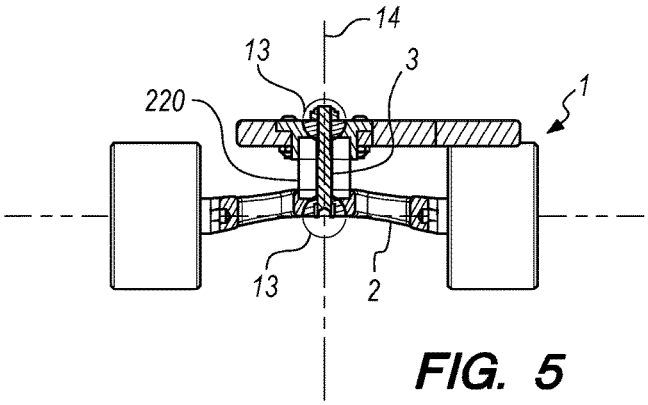
FIG. 5 shows a rear sectional view with no deck lean or steering.
Figure 6:
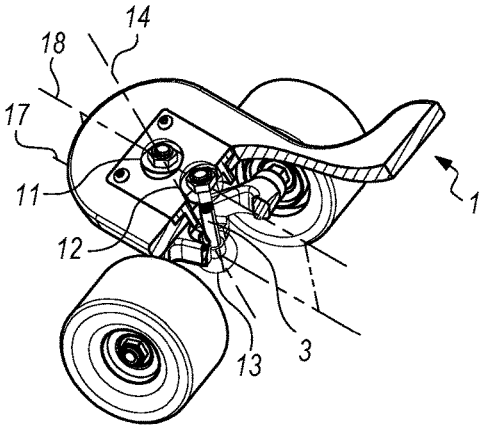
FIG. 6 shows a top perspective sectional view with deck leaned left and truck steering left.
Figure 7:
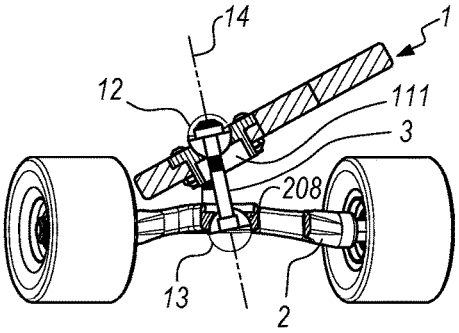
FIG. 7 shows a rear sectional view with deck leaned left and truck steering left.

FIG. 2 shows the three rigid bodies of the present invention. The three rigid bodies are connected by three spherical joints. Motion of the mechanism is constrained by the relationship of the three rigid bodies and by the floating kingpin elastomeric component and the pivot arm elastomeric component. Thus, the present invention is a kinematic linkage of rigid bodies, a space mechanism, with two degrees of freedom plus suspension provided by the elastomeric components.

In the skateboard assembly the first rigid body is deck and baseplate assembly/rigid body 1. In the truck of the present invention, the first rigid body is the baseplate assembly alone, when the truck is not connected with a deck. As used herein, deck and baseplate assembly/rigid body 1 may refer to either the baseplate assembly alone for a truck, or may refer to the deck and baseplate assembly for the skateboard assembly. A preferred embodiment is described in detail herein. Baseplate 101 is mounted to deck 100 by screws 114 and nuts 115. As shown in FIGS. 9-12, baseplate 101 has a top surface 131 with a first hemispheric recess 107 and a second hemispheric recess 105 that provide female bearing surfaces for hemispheric bearings 303 and locations for spherical joints 11 and 12. Baseplate 101 further comprises a baseplate pivot arm elastomeric recess 108 which is comprised of flat surface 109 and a lip or side surface 110, and a baseplate floating kingpin elastomeric recess 111 which is comprised of flat surface 112 and lip 113.

A second rigid body is hanger assembly/rigid body 2 is shown in FIGS. 13-16. Hanger 200 comprises top surface 231, bottom surface 233, horizontal member 212, and two axles 213 wherein each axle connects with a laterally spaced wheel assembly 216. Hanger floating kingpin recess 208 and hanger pivot arm recess 204 are located on top surface 231 of hanger 200. In a preferred embodiment, pivot arm 201 is a projecting vertical member positioned within pivot arm recess 204. In other embodiments, pivot arm 201 may be angled. Pivot arm 201 has a first end 241 and a second end 242, where the second end is securely connected with and fixed to the hanger pivot arm recess 204. The second end may be fused with flat surface 205, it may be press fit, it may be threaded and bolted to the hanger, or the pivot arm may be securely connected by any means known in the art. The first end 241 of pivot arm 201 is received within bore 304*b* of second hemispheric bearing 303*b* and and secured by pivot arm nut 217. Second hemispheric bearing 303*b* may sometimes be called the pivot arm hemispheric bearing 303*b*. Pivot arm hemispheric bearing 303*b* is the male component of second spherical joint 11. Hanger 200 further comprises a third hemispheric recess 211 located in a bottom surface 233 of hanger 200 that provides a female bearing surface for the lower hemispheric bearing 303*c* of floating kingpin assembly 3 and the location for third spherical joint 13. Third hemispheric recess 211 may also be called the hanger hemispheric recess 211.

A third rigid body is floating kingpin assembly/rigid body 3 is shown in FIG. 2. Floating kingpin assembly/rigid body 3 is comprised of floating kingpin 300 with a first end 311 and a second end 312, a first upper hemispheric bearing 303*a* that may be secured to the first end of the floating kingpin by nut 307, and a third lower hemispheric bearings 303*c* that is connected with the second end of the floating kingpin. The upper hemispheric bearing 303*a* is the male component of spherical joint 12 and the lower hemispheric bearing 303*c* is the male component of spherical joint 13. First spherical joint 12 allow the floating kingpin assembly/rigid body 3 to move independently from the baseplate assembly, and third spherical joint 13 the floating kingpin assembly to move independently from the hanger assembly. This pair of spherical joints isolates the floating kingpin assembly.

Assembly of the Invention.

Figure 8:
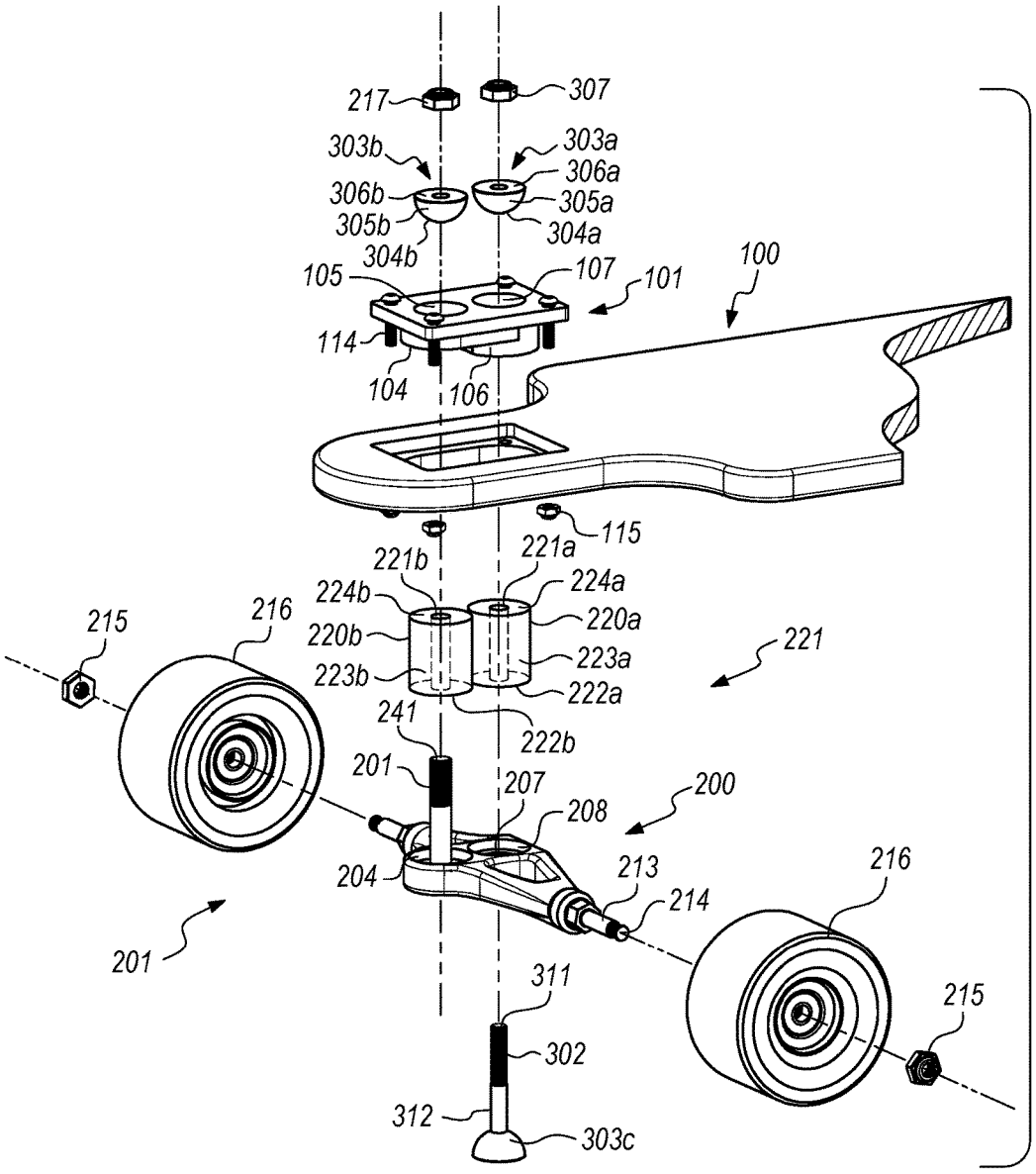
FIG. 8 shows an exploded view of current invention.
Figure 13:
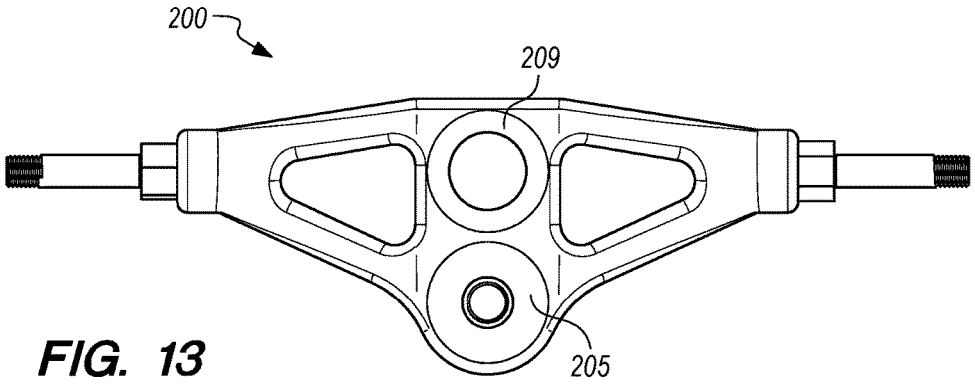
FIG. 13 shows a top view of hanger.
Figure 14:
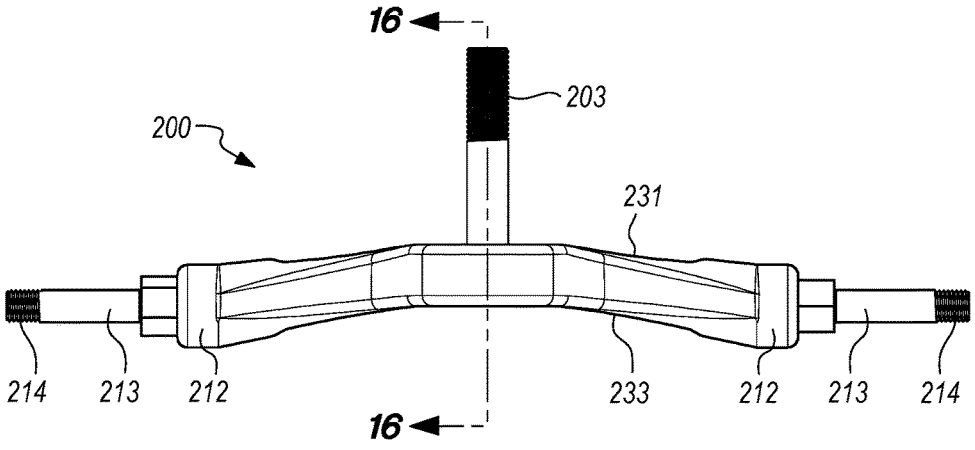
FIG. 14 shows a front view of hanger.
Figure 15:
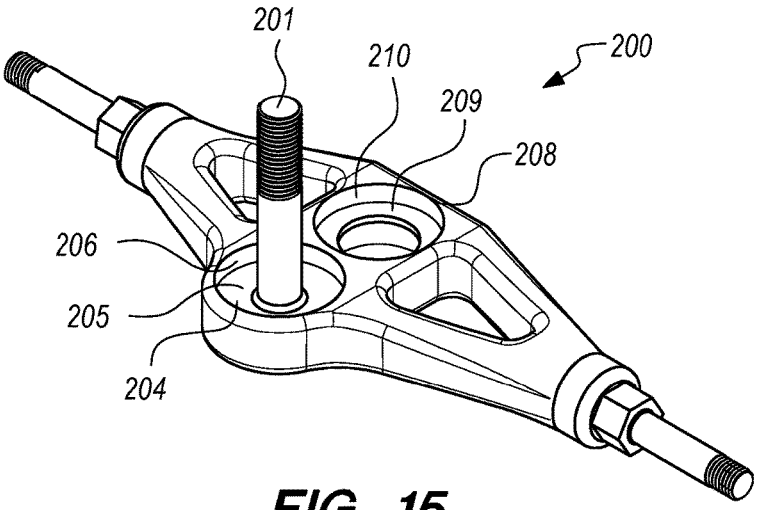
FIG. 15 shows a top perspective view of hanger.
Figure 16:
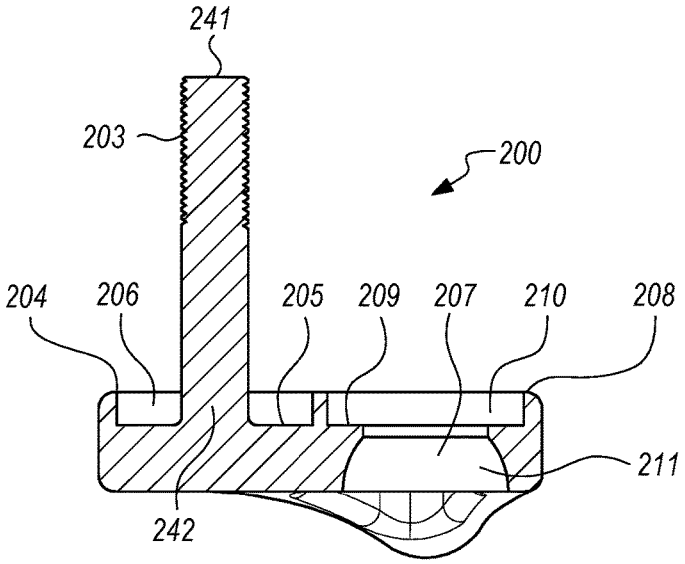
FIG. 16 shows a side sectional view of hanger.

As shown in FIG. 8, assembly of deck and baseplate/rigid body 1 with hanger assembly/rigid body 2 has hanger pivot arm 201 pass through bore 221*b* of pivot arm elastomeric component 220*b*, through bore 104 of baseplate 101, and through bore 304*b* of hemispheric bearing 303*b*. Pivot arm nut 217 threads onto hanger pivot arm 201 using threads 203. Bore 221*b* is sized to receive and constrain hanger pivot arm 201.

Upon tightening nut 217 bottom surface 222*b* of pivot arm elastomeric component 220*b* mates with the flat surface 205 of hanger pivot arm recess 204, the lower portion of outside surface 223*b* of elastomeric component 220*b* is constrained by the lip or side surface 206 of pivot arm recess 204, top surface 224*b* of elastomeric component 220*b* mates with flat surface 109 of baseplate pivot arm recess 108, the upper portion of outside surface 223*b* of elastomeric component 220*b* is constrained by the lip or side surface 110 of recess 108. Bearing surface 305*b* of hemispheric bearing 303*b* mates with the spherical bearing surface 105 in top surface 131 of baseplate 101, and nut 217 mates with the top surface 306 of hemispheric bearing 303.

Tightening nut 217 completes the bolted assembly of elastomerically coupled and constrained spherical joint 11 connecting the rigid bodies of deck and baseplate assembly/rigid body 1 with hanger assembly/rigid body 2. Tightening or loosening nut 217 controls the preload adjustment of elastomeric component 220*b* contained between baseplate and deck assembly 1 and hanger assembly/rigid body 2.

Assembly of floating kingpin assembly/rigid body 3 with rigid bodies 1 and 2 in shown in FIG. 8. Floating kingpin 300 has a first end 311 and a second end 312. In some embodiments, the second end 312 of floating kingpin 300 may comprise a single unit connected with third hemispheric bearing 303*c*. In other embodiments, the second end 312 of floating kingpin 300 may pass through a bore in hemispheric bearing 303*c*. Floating kingpin 300 then passes through bore 207 of the hanger, through bore 221*a* of floating kingpin elastomeric component 220*a*, through bore 106 of baseplate 101, through bore 304*a* of hemispheric bearing 303*a* and threads 302 are threaded into floating kingpin nut 307.

Floating kingpin 300 must be immobilized to tighten floating kingpin nut 307. Floating kingpin 300 may be secured by having a cavity in second end 312 to receive a hex wrench to hold floating kingpin in place, or floating kingpin may be secured and immobilized by a nut, or any other means known in the art to immobilize a bolt while tightening a nut onto the bolt. Upon tightening floating kingpin nut 307, bottom surface 222*a* of elastomeric component 220 mates with flat surface 209 of hanger floating kingpin recess 208; the lower portion of outside surface 223*a* of elastomeric component 220 is constrained by lip 210 of floating kingpin recess 208; top surface 224*a* of elastomeric component 220*a* mates with the flat surface 112 of baseplate floating kingpin recess 111; the upper portion of side surface 223*a* of elastomeric component 220 is constrained by the lip 113 of recess 111; bearing surface 305*a* of hemispheric bearing 303*a* mates with the spherical bearing surface 107; nut 307 mates with the top surface 306*a* of hemispheric bearing 303*a*. In the preferred embodiment, pivot arm 201 and floating kingpin 300 are parallel to each other and are perpendicular to the baseplate when at rest.

Tightening nut 307 completes the bolted assembly of elastomerically coupled and constrained spherical joints 12 and 13 connecting all three rigid bodies. Tightening or loosening nut 307 controls the preload adjustment of elastomeric component 220*a* contained within floating kingpin assembly 3

Axles 213 project from horizontal member 212 of hanger 200. In a preferred embodiment, each axle 213 has threads 214 and passes through the bearings of wheel assembly 216 and thread into nuts 215 securing laterally spaced wheel assemblies 216 to hanger assembly 2, as shown in FIG. 8.

Kinematic Definitions of the Skateboard of the Present Invention

Deck and baseplate assembly/rigid body 1 is an independent rigid body, separated from the other rigid bodies by way of second spherical joint 11 and first spherical joint 12.

Hanger Assembly/rigid body 2 is an independent rigid body, separated from the other rigid bodies by way of second spherical joint 11 and third spherical joint 13.

Floating kingpin assembly/rigid body 3 is an independent rigid body, separated from the other rigid bodies by way of first spherical joint 12 and third spherical joint 13 and is partially contained by an elastomeric component.

In some embodiments, elastomeric components 220*a* and 220*b* which are located between deck and baseplate/rigid body 1 and hanger assembly/rigid body 2 constrain the motion of spherical joints 11, 12, and 13, provide a return to center force, and provide direct load bearing suspension. In other embodiments, shown in FIGS. 37-39 elastomeric component 330 functions in a similar manner to elastomeric components 220*a* and 220*b*. In another embodiment, shown in FIGS. 40-42, elastomeric components 340 and 341 surround and constrain floating kingpin assembly 3A, and there are no elastomeric components on pivot arm 201A. In another embodiment, shown in FIGS. 43-45, pivot arm elastomeric component 350 and floating kingpin elastomeric component 351 are different sizes to allow for alternative steering response and flexibility in industrial design. In all embodiments, the elastomeric components provide suspension. In the preferred embodiment, 100% of a rider's mass is supported by the elastomeric components and 100% of the load path between the ground that the rider passes through the elastomeric components.

Hanger pivot plane 10 is a virtual plane defined by the centroid points of spherical joints 11, 12, and 13. Hanger pivot plane 10 is useful for understanding the motions and degrees of freedom in the present invention.

Figure 17:
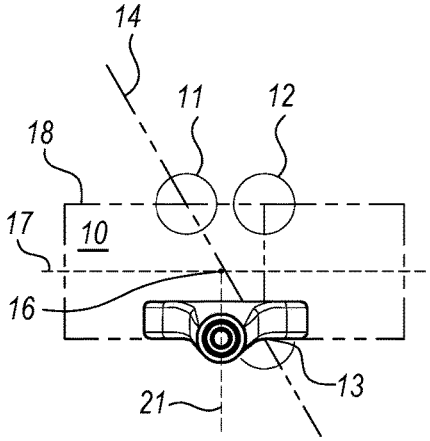
FIG. 17 shows a side view of hanger with forward offset axle axis, with the arrow showing the direction of travel.
Figure 19:
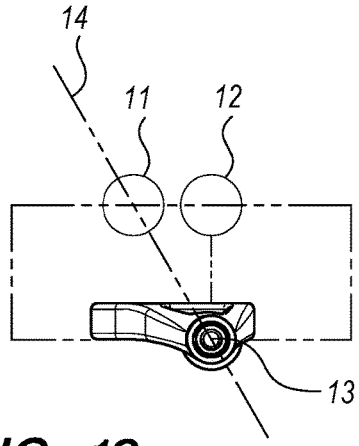
FIG. 19 shows a side view of hanger with zero offset axle axis, with the arrow showing the direction of travel.
Figure 21:
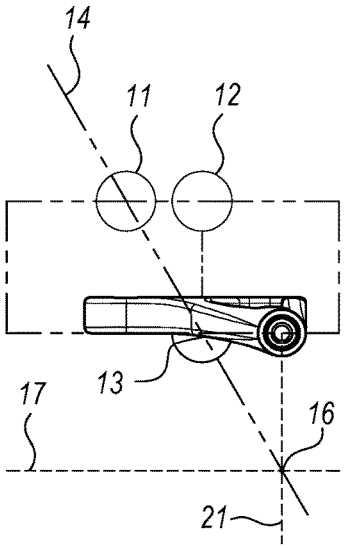
FIG. 21 shows a side view of front hanger with trailing offset axle axis, with the arrow showing the direction of travel.
Figure 23:
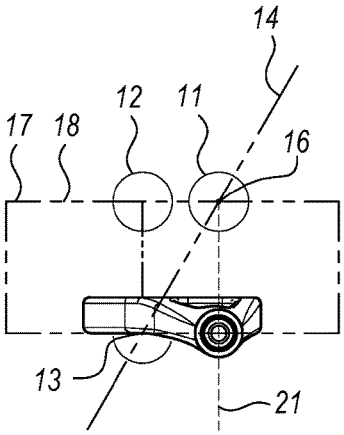
FIG. 23 shows a side view of rear hanger with trailing offset axle axis, with the arrow showing the direction of travel.

In a preferred embodiment, longitudinal roll axis 18 is defined by the centroid points of spherical joints 11 and 12. The hanger pivot axis 14 is defined by the centroid points of spherical joints 11 and 13. Virtual pivot point 16 is defined by the intersection of hanger pivot axis 14 and a line vertically projected from the center of hanger axle axis 15. In some embodiments of the present invention with a zero offset axle axis the virtual pivot point is coincident with the centroid point of spherical joint 13, as shown in FIG. 19. In other embodiments of the present invention projecting line 21 of axle axis 15 intersects hanger pivot axis 14 at locations not coincident with spherical joint 13 and so relocates virtual pivot point 16, as shown in FIGS. 17, 21, and 23.

With the assembly of a skateboard of the present invention a virtual pivot point roll axis 17 is defined by the virtual pivot points of the front and rear truck.

The assembly of a skateboard of the present invention in use with wheels constrained by the ground allows for three primary motions of leaning, steering, and floating. Leaning comprises the motion of the deck, steering comprises the motion of the hanger, and floating is the range of independence between these that allows for a small range of steering without leaning, and leaning without steering.

With the assembly of a skateboard of the present invention in use with wheels constrained by the ground the first primary motion of leaning is a blended combination of rotation of baseplate and deck assembly/rigid body 1 about longitudinal roll axis 18 and virtual pivot point roll axis 17.

With the assembly of a skateboard of the present invention in use with wheels constrained by the ground the second primary motion of steering is rotation of hanger assembly/rigid body 2 around hanger pivot axis 14.

With the assembly of a skateboard of the present invention in use with wheels constrained by the ground a third primary motion of float is a small range of independence between the motions of steering and leaning such that within limits defined by the range of motions of spherical joints 11, 12, and 13 and the elastomeric constraints of elastomeric components 220*a* and 220*b* so that a range of leaning is possible without steering and a range of steering is possible without leaning. The elastomeric components absorb torque and other forces allowing for a range of steering independent of leaning and absorbing other inputs like road vibration and lateral forces that may cause unwanted steering of the hanger.

As will be shown below, the addition of the third primary motion called here float enables yet further kinetic differences and advantages for riders seeking a surfing like ride feel.

Kinetic Description of a Skateboard of the Present Invention

In use with wheels constrained by the ground the skateboard of the present invention has three rigid bodies of deck and baseplate/rigid body 1, hanger assembly/rigid body 2, and floating kingpin assembly/rigid body 3 that are elastomerically coupled and constrained by elastomeric components 220. In some embodiments elastomeric component 220*a* and 220*b* may be combined into a single elastomeric component 330. The elastomeric components are functionally similar, whether a single component, or multiple components. Elastomeric components 220 or 330 are necessary for the integrity of the assembly and enable several key differences and advantages over conventional truck designs.

With pre-existing skateboards rider input torque to lean the deck is transferred directly through the side to side displacement of the fixed kingpin and elastomeric components to the yoke of the hanger resulting in a linked lean-steering response as the hanger rotates about the hanger pivot axis.

In contrast, a skateboard of the present invention has independent rotation of deck and baseplate/rigid body 1 about longitudinal roll axis 18 and independent rotation of hanger assembly/rigid body 2 about hanger pivot axis 14 such that elastomeric components 220 are required to complete the load path and transfer rider input torque from deck and baseplate assembly/rigid body 1 to hanger assembly/rigid body 2 and floating kingpin assembly/rigid body 3. In this way elastomeric components 220 function as elastomeric couplers that transfer rider input torque connecting the otherwise independent motions of leaning and steering, and creating the feeling of floating.

The floating motion of the present invention is understood as range of leaning that does not cause steering and a range of steering that is not sufficient to create leaning. Rider input torque causes the deck and baseplate assembly/rigid body 1 to lean and rotate about longitudinal roll axis 18 and virtual pivot point axis 17, however, transfer of torque through elastomeric components must be sufficient to cause the hanger to rotate about the hanger pivot axis to create steering. Small amounts torque absorbed by elastomeric components will fall below a threshold needed to overcome resistance in the system and do not transfer into perceptible steering or leaning. The amount of torque that may be absorbed by the elastomeric components varies depending on factors including the weight of the rider, the stiffness of the elastomeric components, the tightness of the kingpin nut, and the tightness of the pivot arm nut. This creates the feeling of floating.

When riding a skateboard, the wheels on the ground are subject to asymmetrical road impacts that cause unwanted steering by causing the wheels and hanger to move. The present invention reduces the amount of vibration and unwanted steering that transfers up from the wheels through the trucks to the rider.

The native firmness and preload adjustment of the elastomeric components, and the fit and shape of the recesses 108 and 111, baseplate 101, and recesses 204 and 208 of hanger 200 controls the steering responsiveness of the present invention such that the firmer the elastomeric components and the tighter the preload adjustment of hanger pivot arm 201 and floating kingpin assembly 3 the more immediate the transfer of torque and the faster the steering response. Different sizes and shapes of the elastomeric components and their respective recesses are shown in the Figures by way of example, and not as a limitation on the kind of shapes or sizes of elastomeric components that may be used.

All elastomeric components, including but not limited to 220*a*, 220*b*, 330, 340, 341, 350, and 351, provide return to center force that provides initial resistance to leaning as well as progressively higher levels of resistance to leaning as the deck is leaned deeper.

Elastomeric components 220*a* and 220*b*, 330, 350 and 351 also provide full load bearing suspension that isolates and dampens road vibration.

Ride Dynamics of a Skateboard of the Present Invention

Skateboards operating at higher speed are subject to progressively higher levels of road vibration. In addition, the wheels on the ground will be subject to asymmetrical road impacts that cause unwanted steering. As vibration and unwanted steering transfers up from the wheels through the trucks to the rider the skateboard bounces and feels loosely connected to the ground. At the same time steering becomes hyper sensitive to rider inputs. These conditions combined with lack of rider skill can lead to a type of steering oscillation commonly called "speed wobbles" that often end with catastrophic results.

Expert skateboard riders learn to relax and absorb the unwanted vibration with their body and at the same time learn to adjust to the changing level of input sensitivity as speed increases. Riders seeking control at higher speeds tend to select trucks specifically designed for downhill speeds that have much slower steering response. Riders will set up downhill trucks with firmer elastomeric bushings and higher levels of preload adjustment. So while straight line speed is improved, maneuverability at slower speeds is greatly reduced.

As has been described in sections above, the skateboard assembly with trucks of the present invention has three primary motions of leaning, steering, and floating.

Float and the full load bearing suspension qualities of the elastomeric components allow the trucks of the present invention to isolate and dampen much more unwanted road vibration and road-caused steering impulses than conventional trucks and so provide a smoother ride with improved traction, better control and much more closely mimic the standing on liquid feel of surfing and other board sports.

Float also means that assembled skateboards of the present invention are less sensitive to rider input for the first few degrees of deck lean which isolates steering from unintentional rider input which in turn results in more consistent primary lean-steering response throughout the speed range.

With conventional fixed kingpin trucks lateral forces in turns have little effect on steering.

In contrast, the floating kingpin truck of the present invention has a load path through the truck that results in a secondary lateral steering response such that rider leg extension during a turn results in a subtle steering response of increasing the radius of the turn and a reduction of leg pressure slightly decreases the turn radius. Having this additional means of steering control results in ride dynamics that increase rider precision over when and how long the wheels slide when carving turns near the limit of traction and at the same time dramatically improves the timing and rhythm of linked turns and amplifies the floating sensation between linked turns.

Skateboards with floating kingpin trucks of the present invention have the riding surface of deck 102 very close to longitudinal roll axis 18. This close proximity combined with the blended leaning motion of the deck about longitudinal roll axis 18 and virtual pivot point roll axis 17 results in a foot-to-deck interface and deck motion that more closely mirrors the natural standing-on-water sensation surfing and other board sports.

In combination the above ride dynamics of the present invention represent a new class of lean-steering mechanisms that provide a fluid, surfing like ride feel and control.

Additional Embodiments

Figure 18:
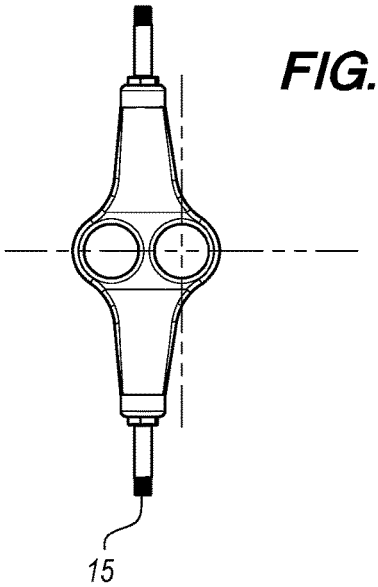
FIG. 18 shows a top view of hanger with forward offset axle axis, with the arrow showing the direction of travel.

FIGS. 17 and 18 show a hanger with a forward offset of axle axis 15 relative hanger pivot axis 14 suitable for injection molding, forged or casted manufacturing methods that utilize a one piece axle.

Figure 20:
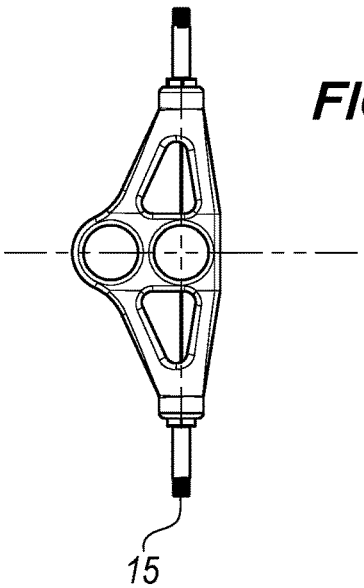
FIG. 20 shows a top view of hanger with zero offset axle axis, with the arrow showing the direction of travel.

FIGS. 19 and 20 show the hanger of the preferred embodiment with zero offset of axle axis 15 relative to hanger pivot axis 14 and coincident with the centroid point of spherical joint 13.

Figure 22:
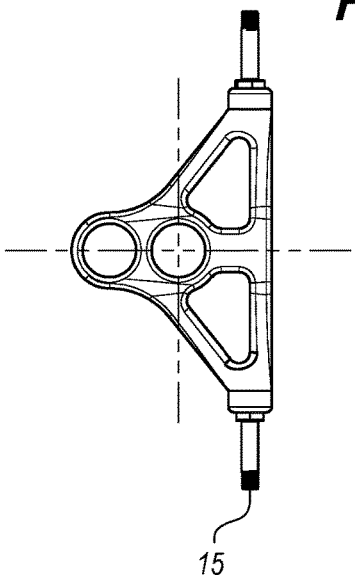
FIG. 22 shows a top view of front hanger with trailing offset axle axis, with the arrow showing the direction of travel.

FIGS. 21 and 22 show a front hanger with a trailing offset of front axle axis 15 relative to front hanger pivot axis 14 for enhanced steering response and tighter turning as well as injection molding, forged or casted manufacturing methods that utilize a one piece axle.

Figure 24:
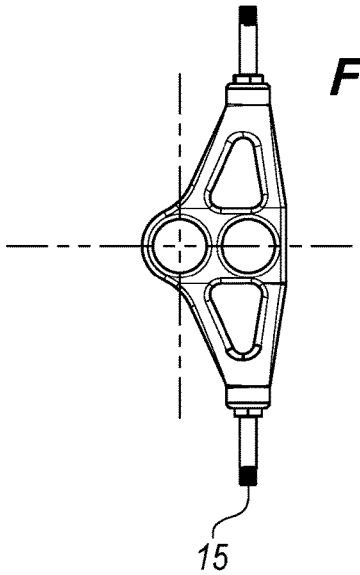
FIG. 24 shows a top view of rear hanger with trailing offset axle axis, with the arrow showing the direction of travel.
Figure 25:
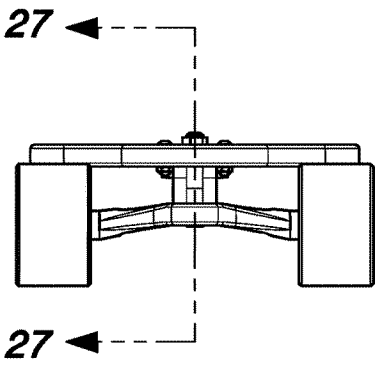
FIG. 25 shows a front view of assembled bidirectional skateboard with a pair of matching zero offset trucks of the preferred embodiment symmetrically mounted on both front and rear of skateboard.
Figure 26:
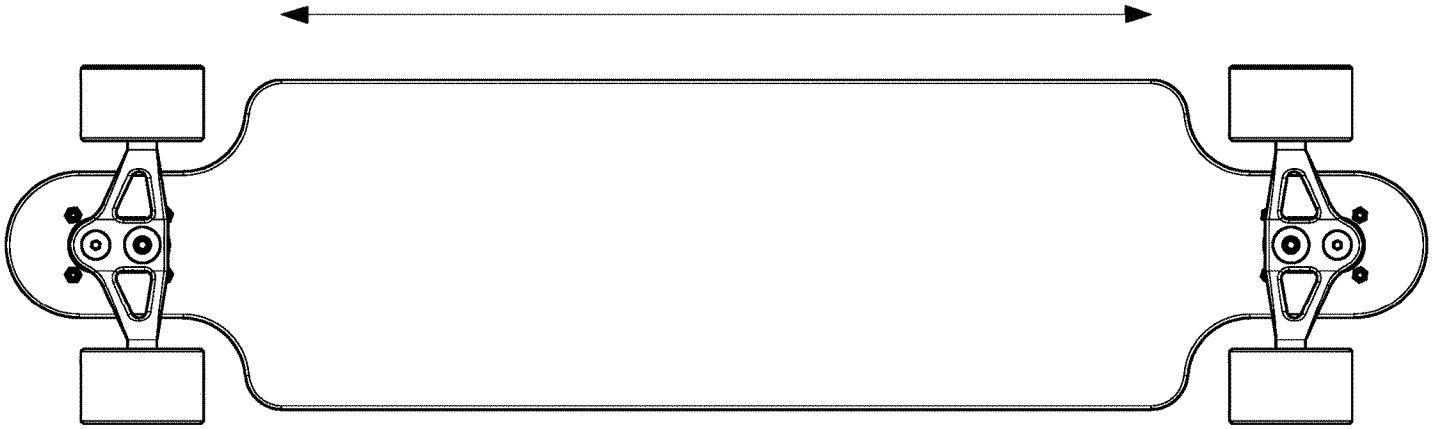
FIG. 26 shows a bottom view of assembled bidirectional skateboard with a pair of matching trucks of the preferred embodiment symmetrically mounted on both front and rear of skateboard, with the arrow showing the bi-directional travel.
Figure 27:
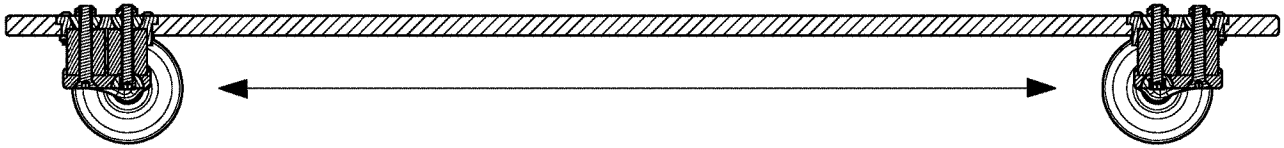
FIG. 27 shows a side sectional view of assembled bidirectional skateboard with a pair of matching trucks of the preferred embodiment symmetrically mounted on both front and rear of skateboard, with the arrow showing the bi-directional travel.
Figure 28:
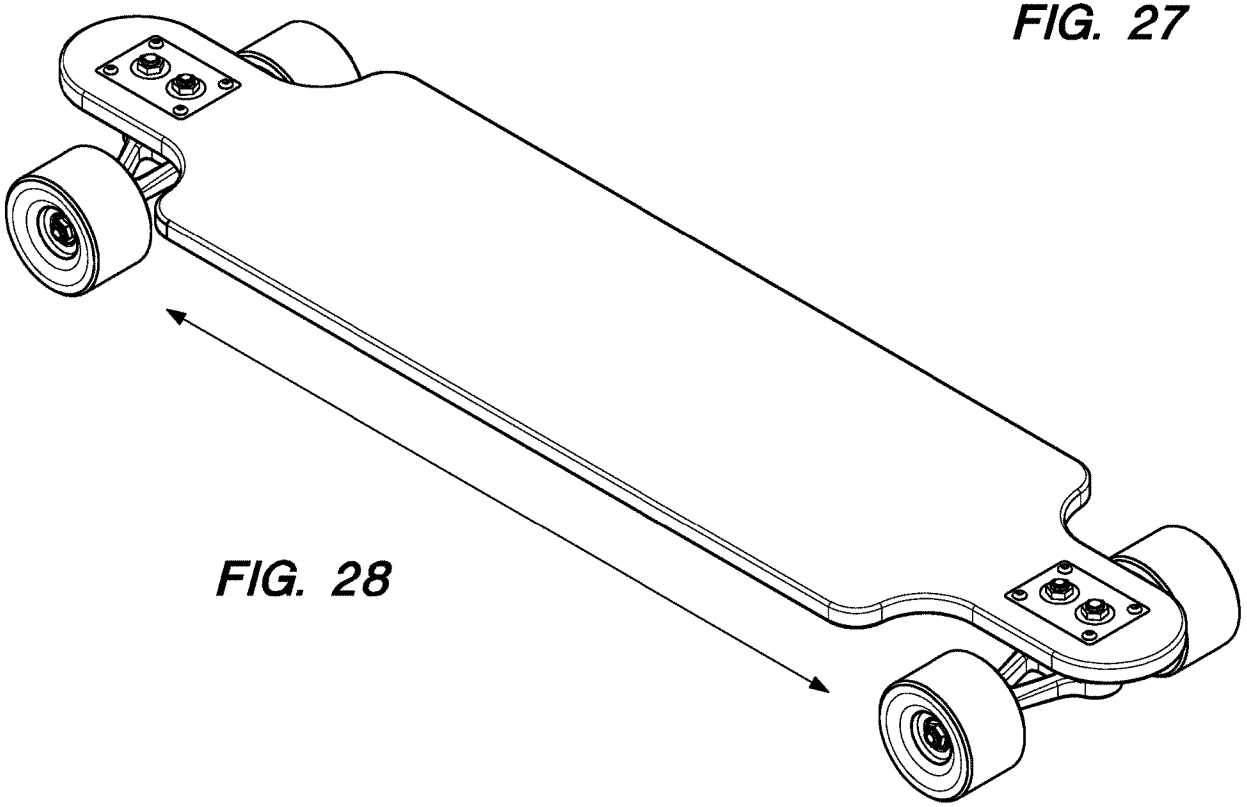
FIG. 28 shows a top perspective view of assembled bidirectional skateboard with a pair of matching trucks of the preferred embodiment symmetrically mounted on both front and rear of skateboard, with the arrow showing the bi-directional travel.
Figure 29:
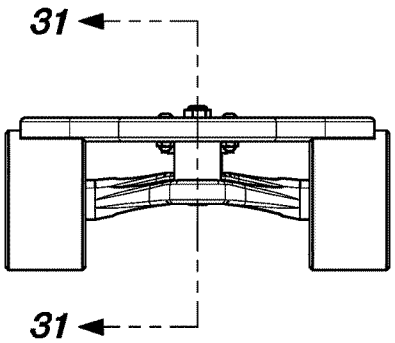
FIG. 29 shows a front view of rear of assembled unidirectional skateboard with dedicated front and rear trucks.
Figure 30:
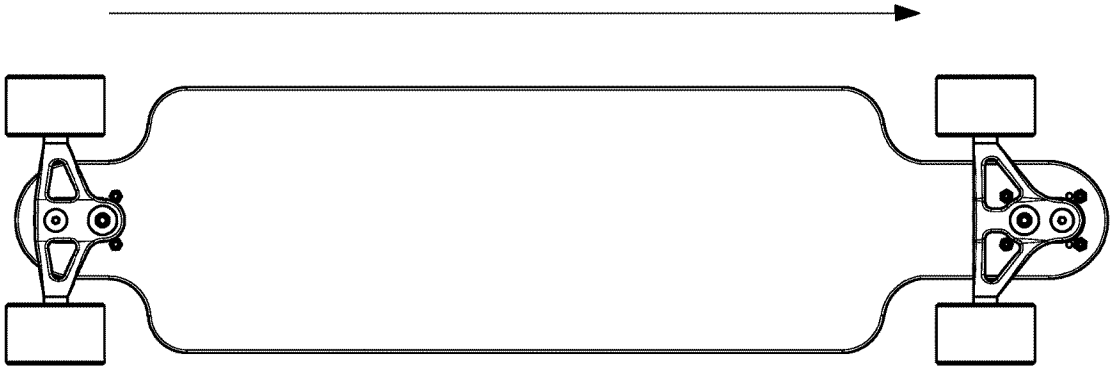
FIG. 30 shows a bottom view of assembled unidirectional skateboard with dedicated front and rear trucks, with the arrow showing the direction of travel.
Figure 31:
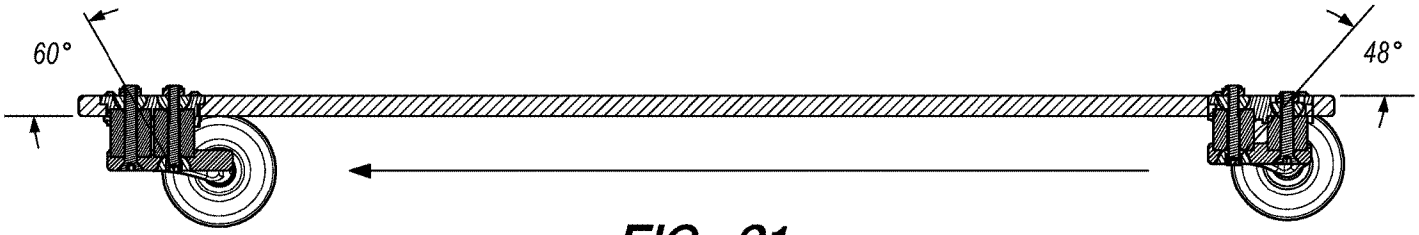
FIG. 31 shows a side sectional view of assembled unidirectional skateboard with dedicated front and rear trucks with differing hanger pivot axis angles, with the arrow showing the direction of travel.
Figure 32:
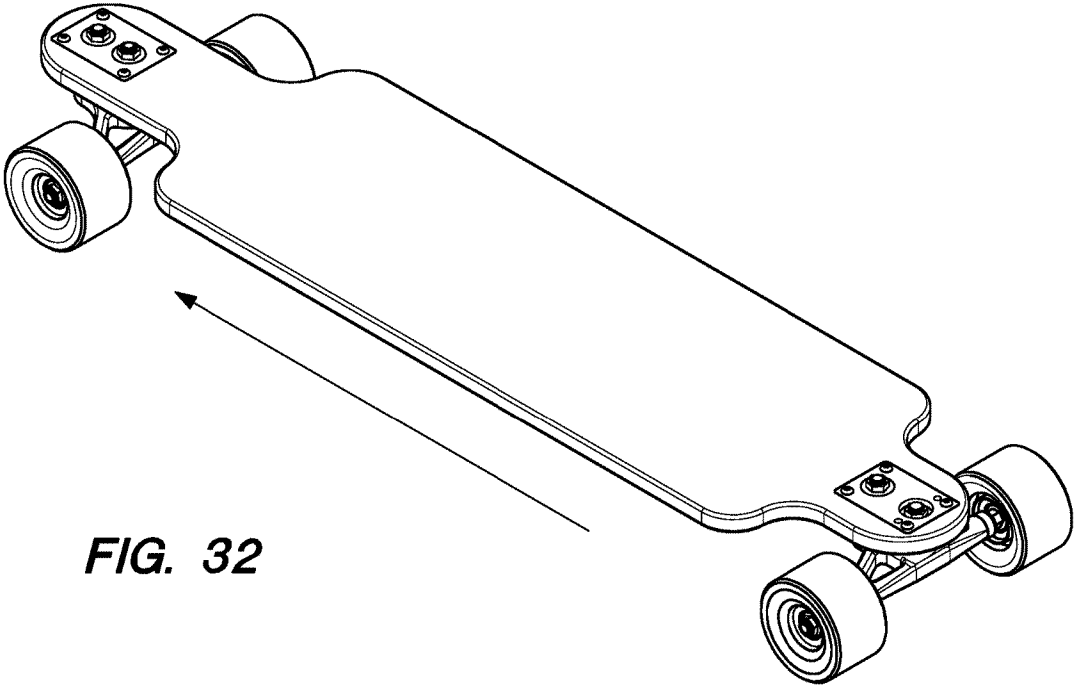
FIG. 32 shows a top perspective view of assembled unidirectional skateboard with dedicated front and rear trucks, with the arrow showing the direction of travel.

FIGS. 23 and 24 show a rear hanger with a trailing offset of rear axle axis 15 relative to rear hanger pivot axis 14 for improved speed stability as well as injection molding, forged or casted manufacturing methods that utilize a one piece axle.

FIGS. 25, 26, 27, and 28 show an assembled bi-directional skateboard of the present invention with a first truck and a second truck of the same design, in other words, the first truck and the second truck are a matched pair, and the first and second truck are symmetrically mounted on the front and rear of skateboard.

FIGS. 29, 30, 31, and 32 show a uni-directional skateboard with dedicated trailing offset truck mounted on the front and a dedicated trailing offset truck mounted on the rear of the skateboard. Also note that the hanger pivot axis angle 19 is different on the front and rear trucks.

Figure 33:
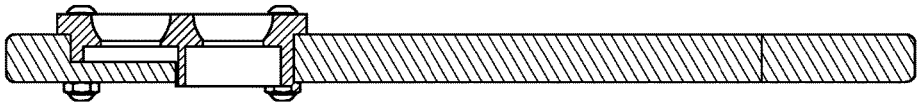
FIG. 33 shows a sectional view of a deck with top mounted baseplate.

FIG. 33 shows a deck and baseplate assembly with the baseplate mounted on top of the deck.

Figure 34:
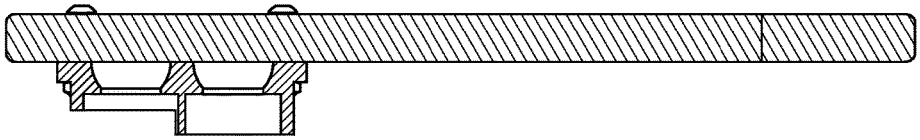
FIG. 34 shows a sectional view of a deck with bottom mounted baseplate.

FIG. 34 shows a deck and baseplate assembly with the baseplate mounted on the bottom of the deck.

Figure 35:
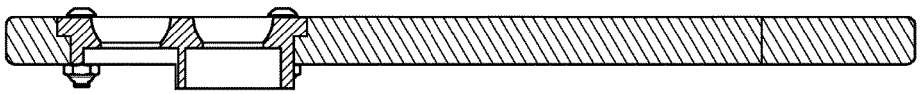
FIG. 35 shows a sectional view of a deck with baseplate mounted within the deck.

FIG. 35 shows a deck and baseplate assembly with the baseplate mounted within the deck.

Figure 36:
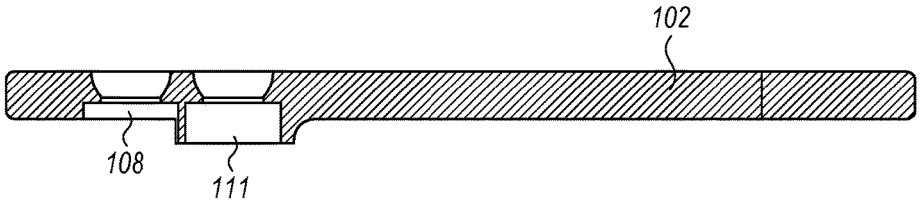
FIG. 36 shows a sectional view of an embodiment of a deck with integrated baseplate features of the present invention.

FIG. 36 shows deck 102 with an integrated baseplate features. In this embodiment the baseplate floating kingpin recess 111, baseplate floating kingpin flat surface, and floating kingpin lip, and the baseplate pivot arm recess 108, the pivot arm flat surface, and pivot arm lip are integrated with the deck. The top of floating kingpin elastomeric component 220*a* mates with the integrated floating kingpin recess, and the top of pivot arm elastomeric component 220*b* mates with the integrated pivot arm recess. This embodiment is suitable for injection molding and produces a reduction of part count for cost efficiency.

Figure 37:
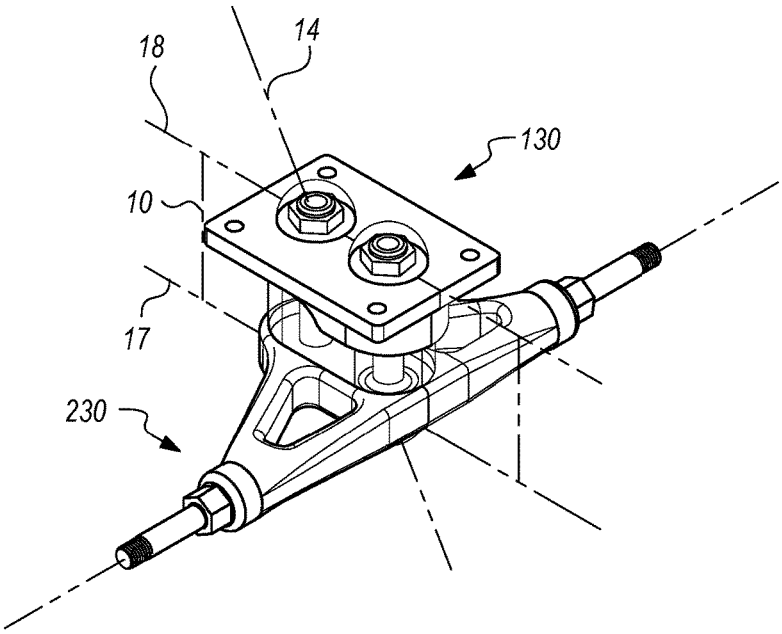
FIG. 37 shows a top perspective view of an embodiment of the truck of the present invention with a single elastomeric component.
Figure 38:
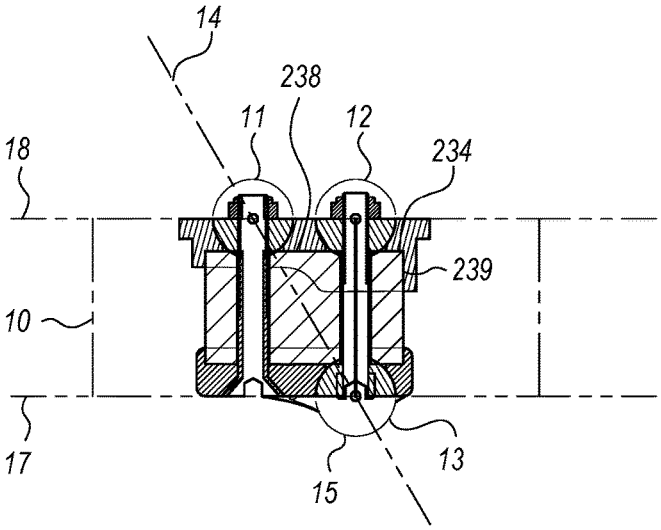
FIG. 38 shows a front view of an embodiment of a truck of the present invention with a single elastomeric component.
Figure 39:
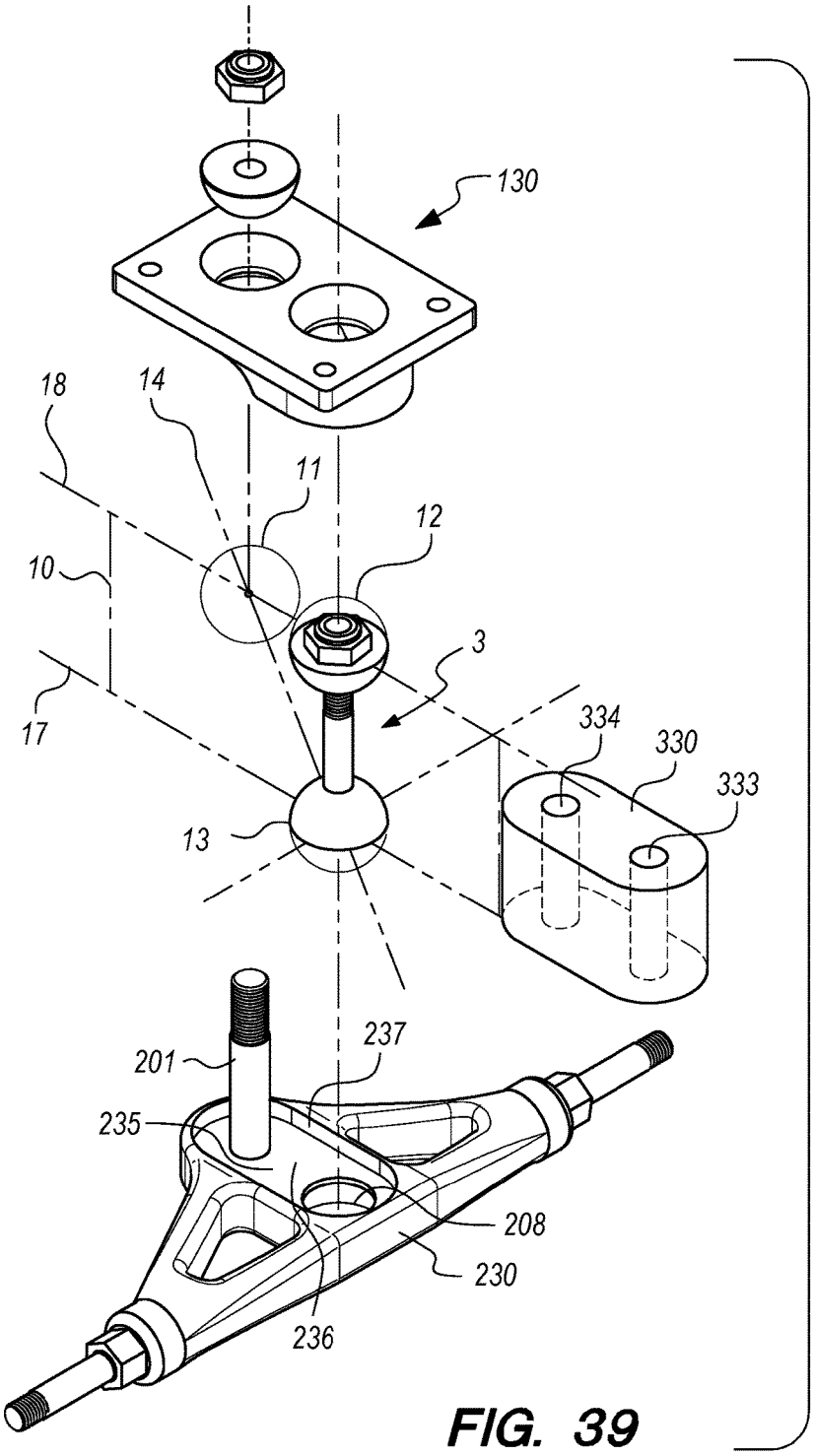
FIG. 39 shows a side exploded view of an embodiment of a truck of the present invention with a single elastomeric component showing the three rigid bodies.

FIGS. 37-39 show a truck of the present invention with a single monolithic elastomeric component 330 to provide increased straight line stability and return to center spring force instead of two individual elastomeric components 220*a* and 220*b* as shown in the preferred embodiment. This single elastomeric component 330 is received and constrained by single cavity recess 234 of baseplate 130 and single cavity recess 235 of hanger 230. The hanger single cavity recess 235 has a single flat surface 236 with contiguous lip 237. Bore 208 for receiving the floating kingpin and pivot arm 201 are located within single flat surface 236. The bottom surface of elastomeric component 330 mates with flat surface 236 and the lower portion of the outside surface elastomeric component 330 is constrained by contiguous lip 237 of single cavity recess 235. The baseplate single cavity recess 234 likewise has a flat surface 238 and contiguous lip 239. The top surface of elastomeric component 330 mates with flat surface 238 of baseplate single cavity recess 234, the upper portion of outside surface of elastomeric component 330 is constrained by contiguous lip 239. Elastomeric component 330 has a pivot arm bore for receiving and constraining the pivot arm, and a floating kingpin bore for receiving and constraining the floating kingpin.

These different embodiments show that elastomeric components may vary by size, shape, number, hardness, and other material qualities and still remain consistent with the suspension and torque transfer functions of the present invention.

Figure 40:
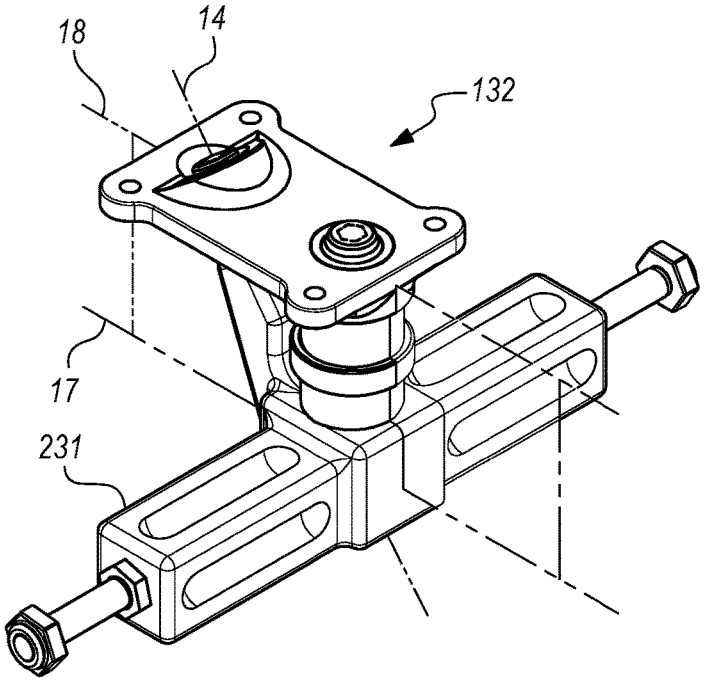
FIG. 40 shows a perspective assembled view of an embodiment of the present invention showing elastomeric components located on floating kingpin and not on pivot arm.
Figure 41:
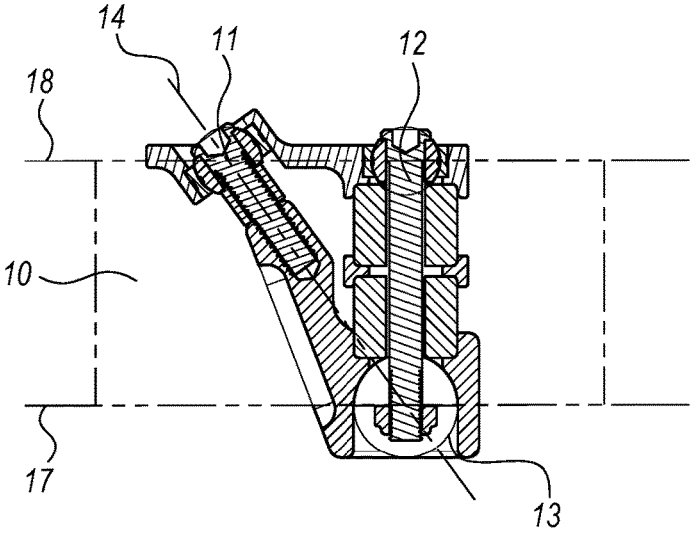
FIG. 41 shows a side section view of an embodiment of the present invention showing elastomeric components located on floating kingpin and not on pivot arm.
Figure 42:
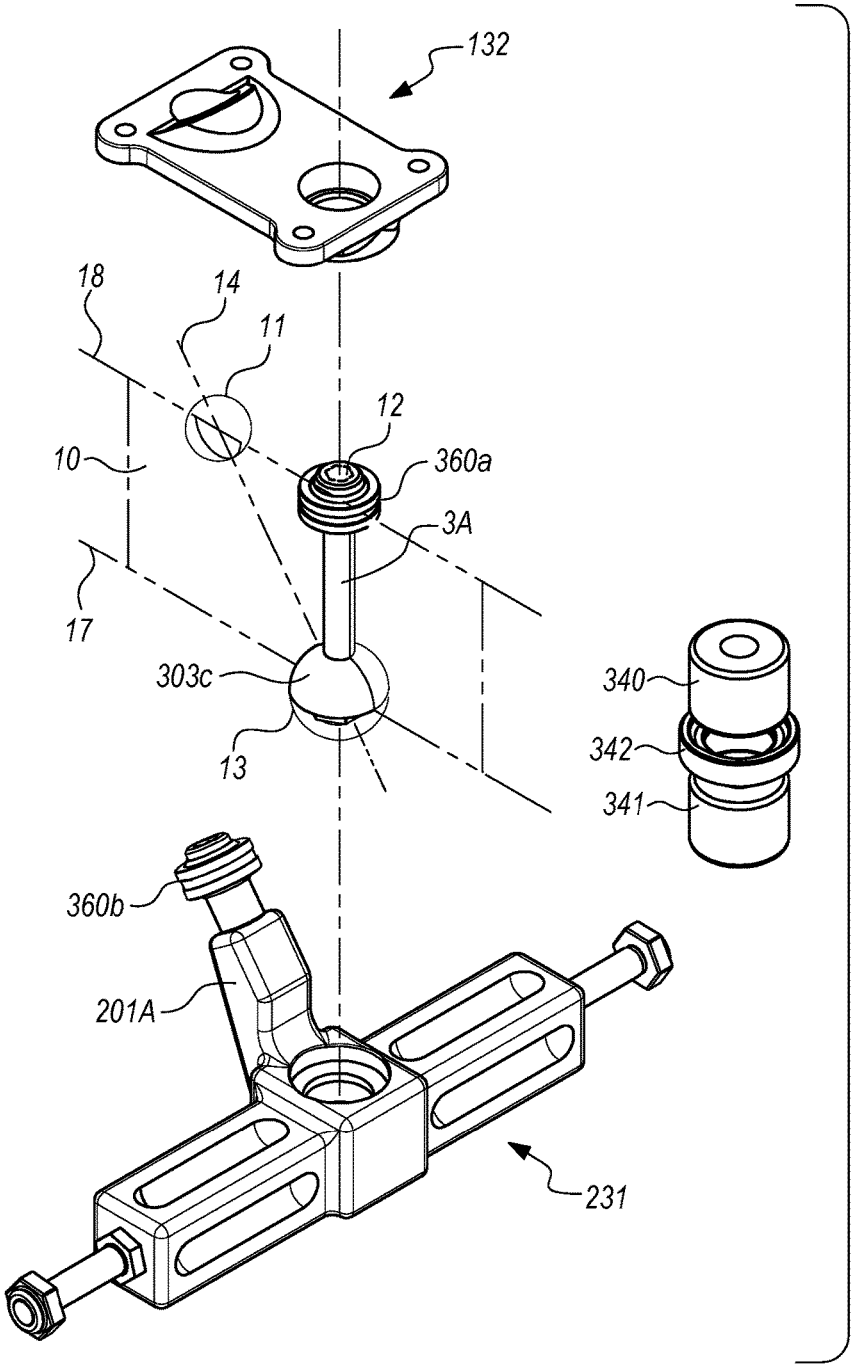
FIG. 42 shows an exploded perspective view of an embodiment of the present invention showing elastomeric components located on floating kingpin and not on pivot arm.

FIGS. 40-42 show an embodiment of the present invention with elastomeric components 340 and 341 located on floating kingpin assembly 3A and not on pivot arm 201A that allows for a closer resemblance to the appearance of a traditional fixed kingpin truck and other industrial design considerations. In this embodiment, third spherical joint 13 is formed by hemispheric bearing 303*c* as in the preferred embodiment. However, second spherical joint 11 is formed by spherical bearing 360*b* and first spherical joint 12 is formed by spherical bearing 360*a* rather than hemispheric bearings 303 showing that alternative construction methods can be utilized.

Figure 43:
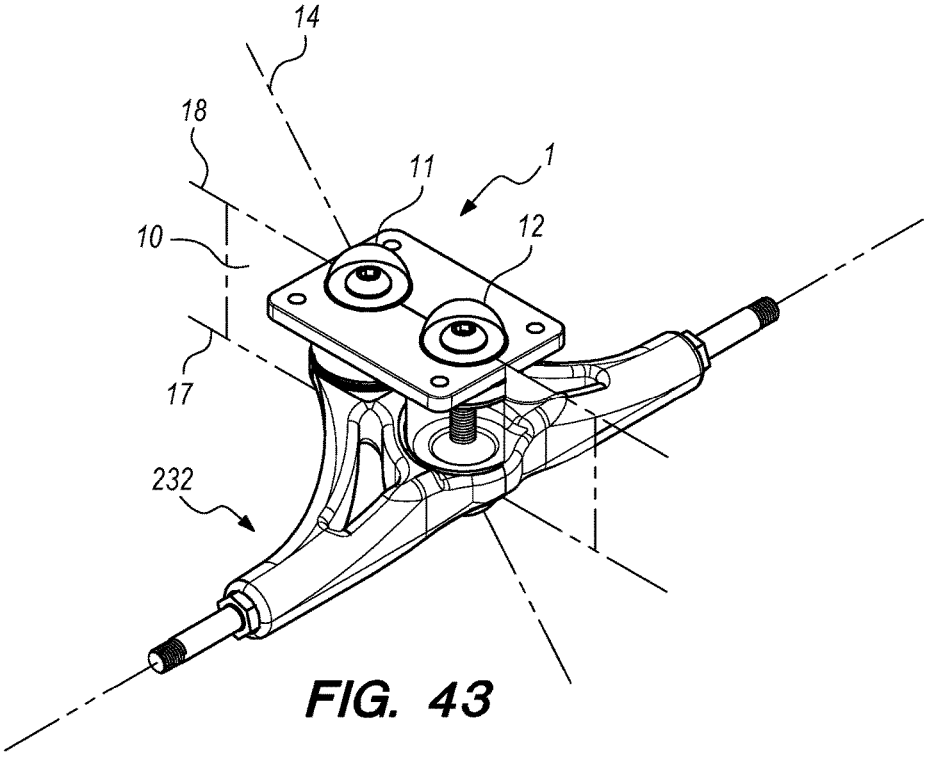
FIG. 43 shows a perspective assembled view of embodiment of the present invention with different size elastomeric components on floating kingpin and pivot arm.
Figure 44:
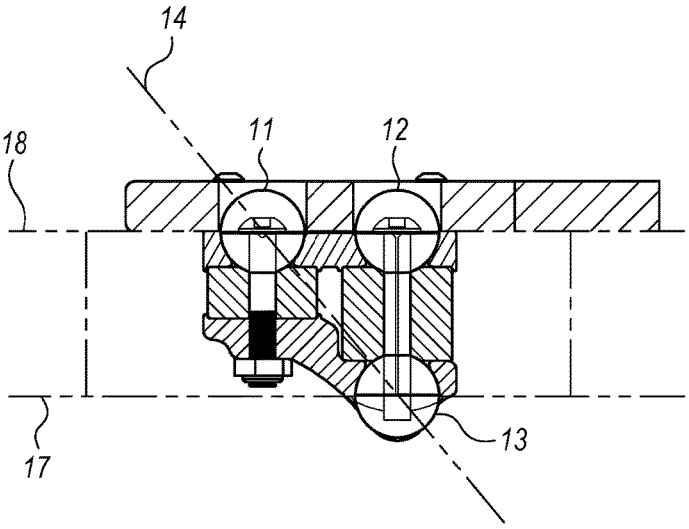
FIG. 44 shows a side section view of embodiment of the present invention with different size elastomeric components on floating kingpin and pivot arm.
Figure 45:
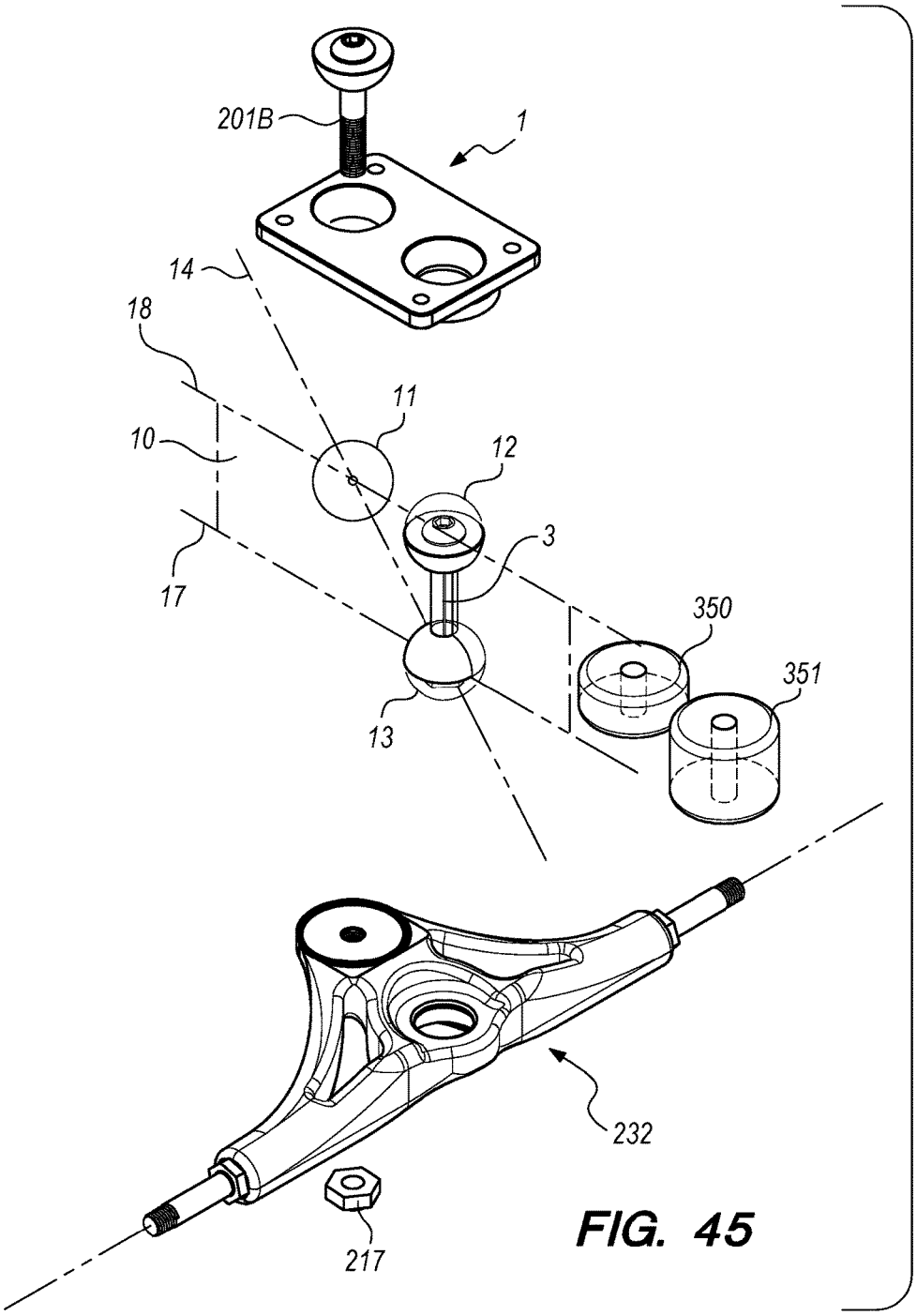
FIG. 45 shows an exploded perspective view of embodiment of the present invention with different size elastomeric components on floating kingpin and pivot arm

FIGS. 43-45 show an embodiment of the present invention with an alternative pivot arm construction and different size elastomeric components. Hanger pivot arm recess 204 is positioned closer to baseplate 101 than hanger floating kingpin recess 208, and pivot arm elastomeric component 220*b* is shorter than floating kingpin elastomeric component 220*a*. Pivot arm 201B threads into and is rigidly connected to hanger 232 by threaded and bolted means, or by other means known in the art to rigidly connect. Pivot arm elastomeric component 350 and floating kingpin elastomeric component 351 are different sizes to allow for alternative steering response and flexibility in industrial design.

Figure 46:
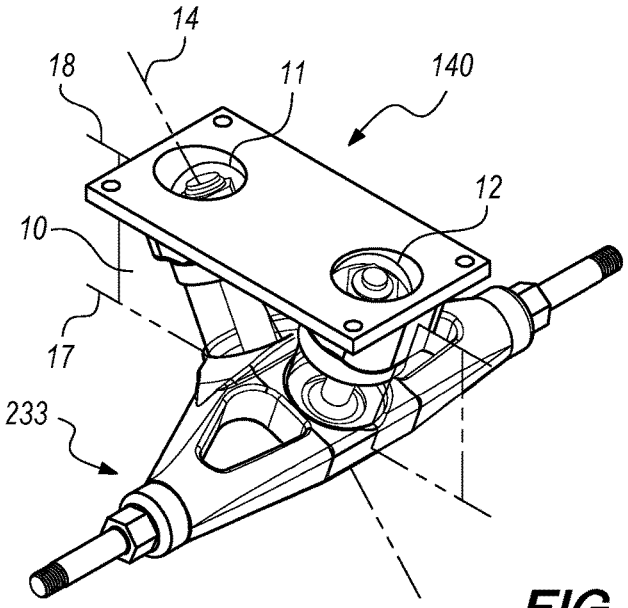
FIG. 46 shows a perspective assembled view of embodiment of the present invention with pivot arm and floating kingpin at an angle other than perpendicular to the mounting surface of the baseplate.
Figure 47:
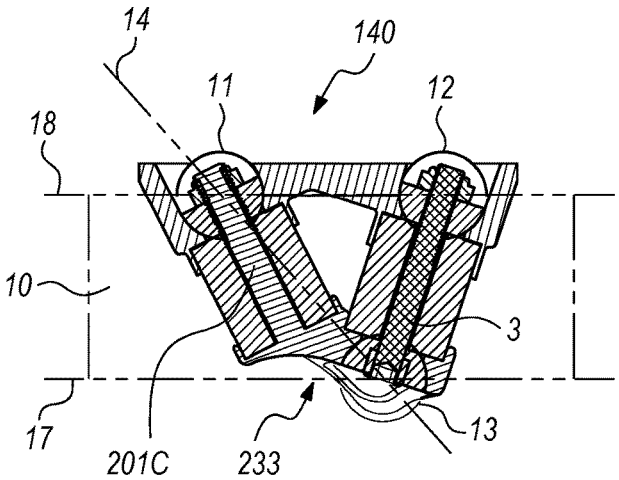
FIG. 47 shows a side section view of embodiment of the present invention with pivot arm and floating kingpin at an angle other than perpendicular to the mounting surface of the baseplate.
Figure 48:
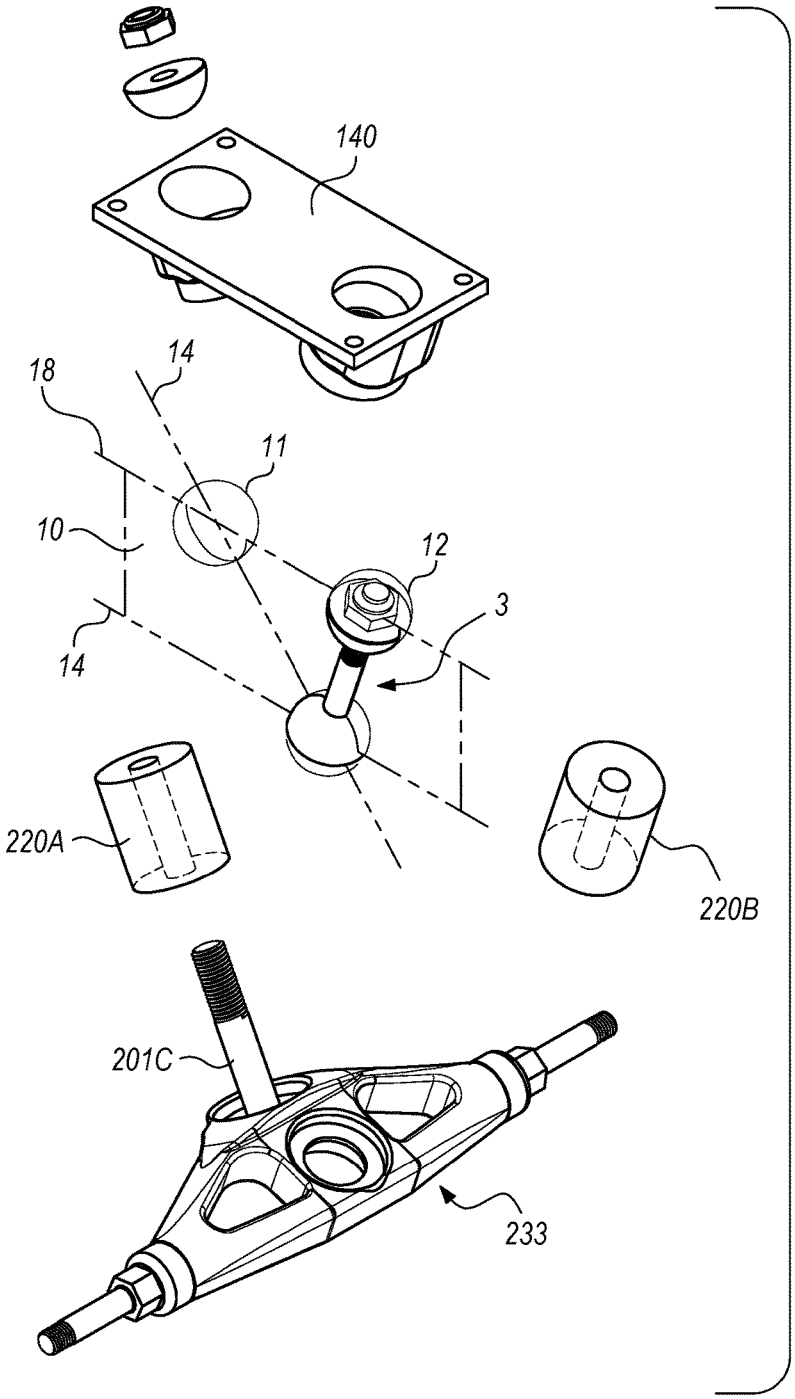
FIG. 48 shows a perspective exploded view of embodiment of the present invention with pivot arm and floating kingpin at an angle other than perpendicular to the mounting surface of the baseplate.
Figure 49:
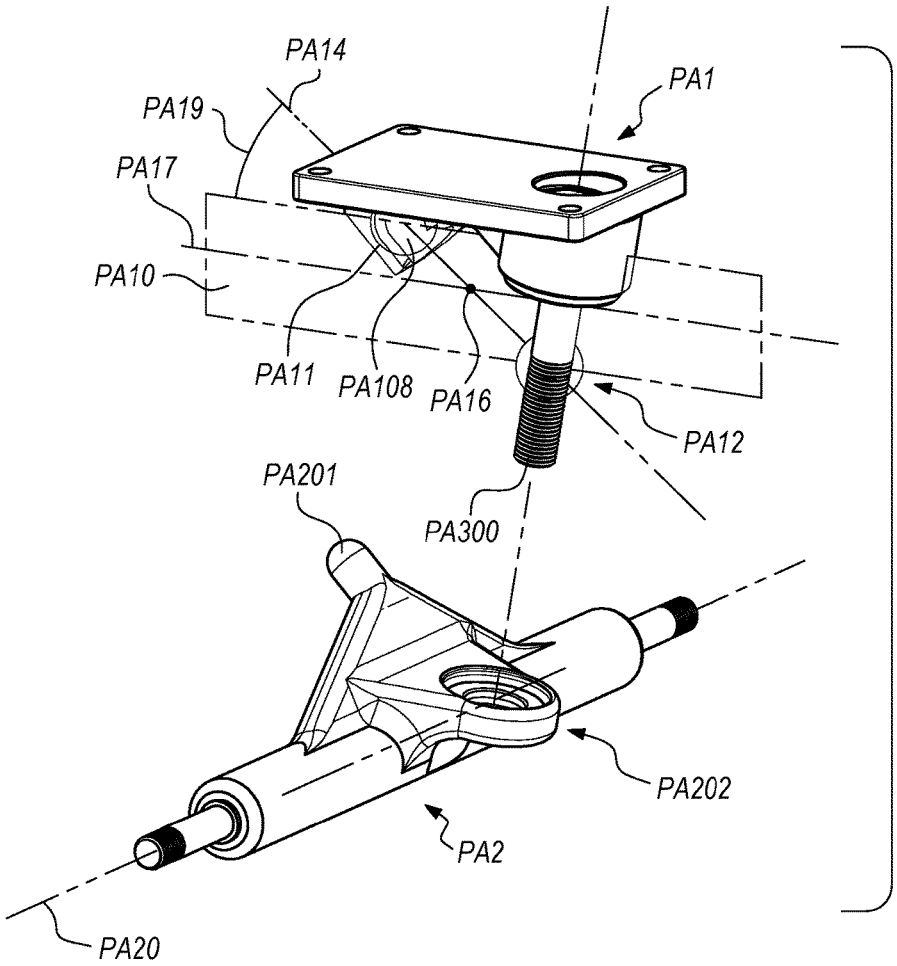
FIG. 49 PRIOR ART
FIG. 49 shows an exploded perspective view of the two rigid bodies of a fixed kingpin of the prior art.
Figure 50:
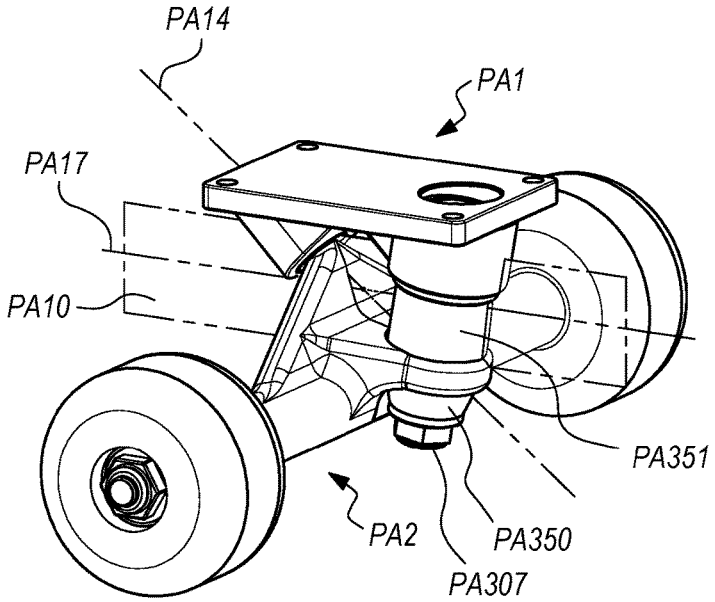
FIG. 50 PRIOR ART
FIG. 50 shows a perspective view of an assembly of a fixed kingpin truck of the prior art.
Figure 51:
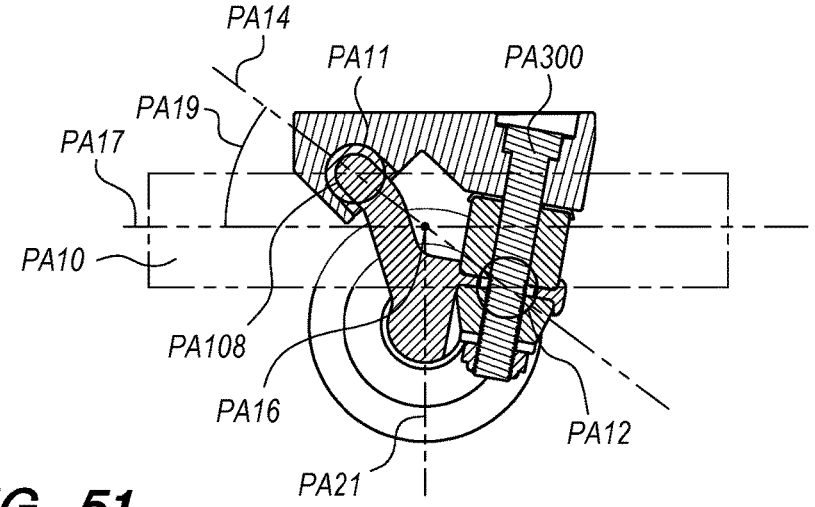
FIG. 51 PRIOR ART
FIG. 51 shows a side section view of a fixed kingpin truck of the prior art.
Figure 52:
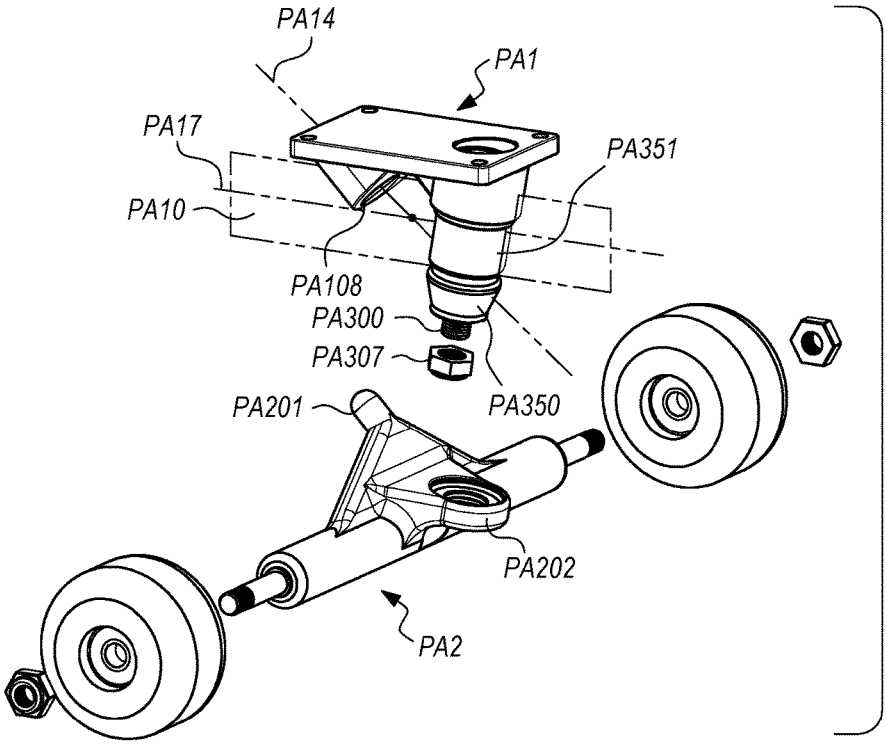
FIG. 52 PRIOR ART
FIG. 52 shows an exploded perspective view of a fixed kingpin truck of the prior art.
Figure 53:
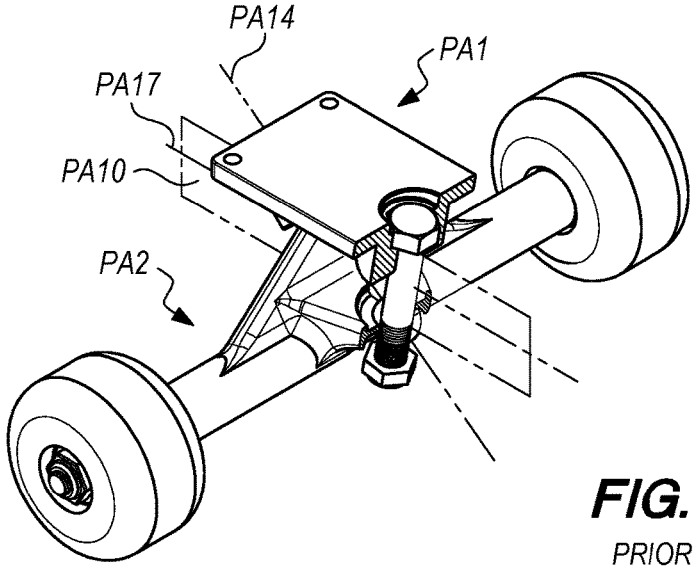
FIG. 53 PRIOR ART
FIG. 53 shows a perspective view partial rear section of a fixed kingpin truck of the prior art with no deck lean or steering.
Figure 54:
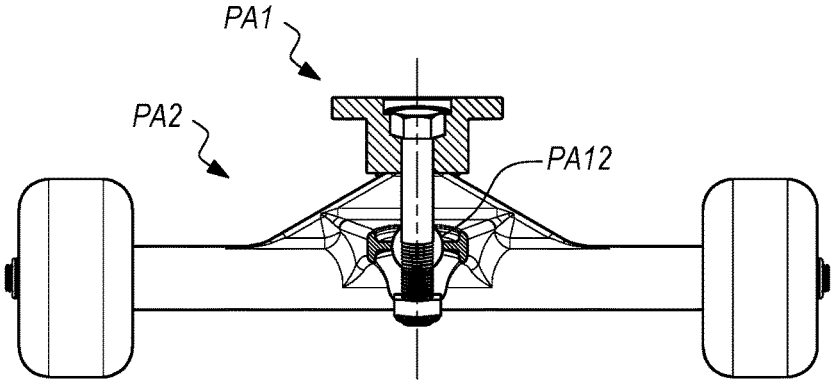
FIG. 54 PRIOR ART
FIG. 54 shows a rear partial section of a fixed kingpin truck of the prior art with no deck lean or steering.
Figure 55:
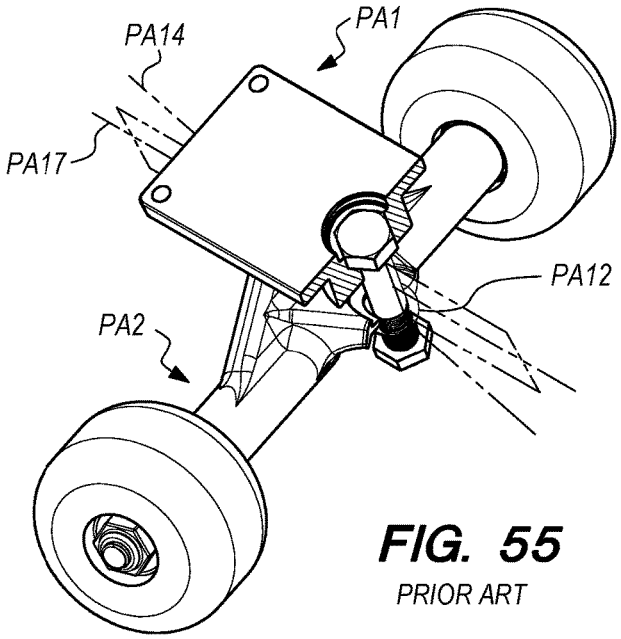
FIG. 55 PRIOR ART
FIG. 55 shows a perspective view partial rear section of a fixed kingpin truck of the prior art with deck leaned left and steering left.
Figure 56:
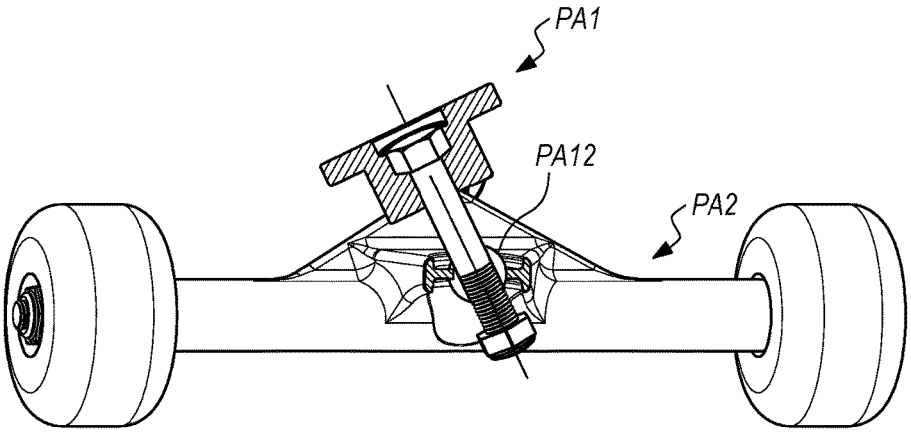
FIG. 56 PRIOR ART
FIG. 56 shows a rear partial section of a fixed kingpin truck of the prior art with deck leaned left and steering left.

FIGS. 46-48 show an embodiment of the present invention with pivot arm 201C and floating kingpin assembly 3 at an angle other than perpendicular to the mounting surface of the baseplate to allow flexibility in industrial design and manufacturing. The baseplate pivot arm recess and the baseplate floating kingpin recess are angled, and the hanger pivot arm recess and the hanger baseplate floating kingpin recess are angled in a complementary manner so that the elastomeric components 220*a* and 220*b* mate with the respective flat surfaces and lips, and are also angled. The baseplate pivot arm recess and the baseplate floating kingpin recess are angled, the hanger pivot arm recess and the hanger floating kingpin recess are complementarily angled, the pivot arm elastomeric component mates with the baseplate pivot arm recess and the hanger pivot arm recess, the floating kingpin elastomeric component mates with the baseplate floating kingpin recess and the hanger floating kingpin recess, and the pivot arm and floating kingpin are not parallel to each other and are not perpendicular to the baseplate when at rest.

The above description presents the best mode contemplated in carrying out the invention(s) described herein. However, it is susceptible to modifications and alternate constructions from the embodiments shown in the figures and accompanying description. Consequently, it is not intended that the invention be limited to the particular embodiments disclosed. On the contrary, the invention is intended to cover all modifications, sizes and alternate constructions falling within the spirit and scope of embodiments of the invention.

What is claimed is:

1. A truck assembly comprising:

three rigid bodies wherein, a first rigid body comprises a baseplate assembly, a second rigid body comprises a hanger assembly, and a third rigid body comprises a floating kingpin assembly, three spherical joints wherein, a first spherical joint moveably connects a first end of a floating king pin with a baseplate, a second spherical joint moveably connects a first end of a pivot arm with the baseplate, and a third spherical joint moveably connects a second end of the floating king pin with a hanger, the pivot arm with a second end that is fixed within a hanger pivot arm recess, a pivot arm elastomeric component positioned between the hanger and the baseplate with a bore sized to receive and constrain the pivot arm, a floating kingpin elastomeric component positioned between the hanger and the baseplate with a bore sized to receive and constrain the floating kingpin, and two degrees of freedom wherein, a first degree of freedom is rotation around a hanger pivot axis defined by a centroid point of the second spherical joint and a centroid point of the third spherical joint, a second degree is freedom is rotation around a longitudinal roll axis defined by the centroid point of the first spherical joint and a centroid point of the second spherical joint.

2. The truck assembly of claim 1 wherein, the baseplate assembly/first rigid body further comprises:

the baseplate, a top surface of the baseplate with a first hemispheric recess and second hemispheric recess, a bottom surface of the baseplate with a floating kingpin recess and a pivot arm recess where the floating kingpin recess is comprised of a flat surface and a lip, and the pivot arm recess is comprised of a flat surface and a lip, the hanger assembly/second rigid body further comprises:

the hanger with a horizontal member that connects with two laterally spaced axles where each axle connects with a wheel assembly, a top surface of the hanger with a floating kingpin recess and a pivot arm recess where the floating kingpin recess is comprised of a flat surface and a lip, and the pivot arm recess is comprised of a flat surface and a lip, the pivot arm with a first end and a second end where the second end of the pivot arm is positioned within and connected with the hanger pivot arm recess, a second hemispheric bearing with a bore for receiving the first end of the pivot arm and a pivot arm nut that secures the second hemispheric bearing to the pivot arm, a bottom surface of the hanger with a hanger hemispheric recess, a bore through the hanger within the hanger hemispheric recess for receiving the floating kingpin, the floating kingpin assembly/third rigid body further comprises:

a floating kingpin with the first end and a second end, a first hemispheric bearing with a bore that receives the first end of the floating king pin, and a floating kingpin nut that secures the first hemispheric bearing to the first end of the floating kingpin, a third hemispheric bearing connected with the second end of the floating kingpin, wherein the first hemispheric bearing mates with the first hemispheric recess in the top surface of the baseplate thereby defining the first spherical joint, the second hemispheric bearing mates with the second hemispheric recess in the top surface of the baseplate thereby defining the second spherical joint, and the third hemispheric bearing mates with the third hemispheric recess in the bottom surface of the hanger thereby defining the third spherical joint, the pivot arm elastomeric component further comprises:

a top surface, a bottom surface, an outside surface, and a bore sized to receive and constrain the pivot arm, the bottom surface of the pivot arm elastomeric component mates with the flat surface of the hanger pivot arm recess and a lower outside surface of the elastomeric component is constrained by the lip of the hanger pivot arm recess, the top surface of the pivot arm elastomeric component mates with the flat surface of the baseplate pivot arm recess and an upper outside surface of the elastomeric component is constrained by the lip of the baseplate pivot arm recess, the floating kingpin elastomeric component further comprises:

a top surface, a bottom surface, an outside surface, and a bore sized to receive and constrain the floating kingpin, the bottom surface of the floating kingpin elastomeric component mates with the flat surface of the hanger kingpin recess and a lower outside surface of the elastomeric component is constrained by the lip of the hanger kingpin recess, the top surface of the floating kingpin elastomeric component mates with the flat surface of the baseplate floating kingpin recess and an upper outside surface of the elastomeric component is constrained by the lip of the baseplate floating kingpin recess, wherein the elastomeric components absorb small amounts of torque to create floating, and wherein the elastomeric components provide full suspension.

3. The truck assembly of claim 2 wherein, the hanger pivot arm recess is closer to the baseplate than hanger floating kingpin recess, and pivot arm elastomeric component is shorter than floating kingpin elastomeric component.

4. The truck assembly of claim 2 wherein, the baseplate floating kingpin recess and the baseplate pivot arm recess comprise a baseplate single cavity recess with a single flat surface and contiguous lip, the hanger floating kingpin recess and the hanger pivot arm recess comprise a hanger single cavity recess with a single flat surface and contiguous lip, the floating king pin elastomeric component and pivot arm elastomeric component comprise a single elastomeric component with a pivot arm bore and a floating kingpin bore, a top surface of the single elastomeric component mates with the baseplate single flat surface and an upper outside surface of the single elastomeric component is constrained by the contiguous lip of the baseplate single cavity recess, and a bottom surface of the single elastomeric component mates with the hanger single flat surface and a lower outside surface of the single elastomeric component is constrained by the contiguous lip of the hanger single cavity recess.

5. The truck assembly of claim 2 wherein, the pivot arm and floating kingpin are parallel to each other and are perpendicular to the baseplate when at rest.

6. The truck assembly of claim 2 wherein, the baseplate pivot arm recess and the baseplate floating kingpin recess are angled, the hanger pivot arm recess and the hanger floating kingpin recess are complementarily angled, the pivot arm elastomeric component mates with the baseplate pivot arm recess and the hanger pivot arm recess, the floating kingpin elastomeric component mates with the baseplate floating kingpin recess and the hanger floating kingpin recess, the pivot arm and floating kingpin are not parallel to each other and are not perpendicular to the baseplate when at rest.

7. The truck assembly of claim 2 wherein, the laterally spaced axles have an axle axis and the axle axis is forward offset relative to a hanger pivot axis.

8. The truck assembly of claim 2 wherein, the laterally spaced axles have an axle axis and the axle axis is trailing offset relative to a hanger pivot axis.

9. The truck assembly of claim 2 wherein, the laterally spaced axles have an axle axis and the axle axis is zero offset relative to a hanger pivot axis.

10. A skateboard assembly with a skateboard deck and two trucks comprising:

a first truck connected with a first end of the deck, a second truck connected with a second end of the deck, each truck comprising:

three rigid bodies wherein a first rigid body comprises a deck and baseplate assembly, a second rigid body comprises a hanger assembly with laterally spaced wheels, and a third rigid body comprises a floating kingpin assembly, three spherical joints wherein a first spherical joint moveably connects a first end of a floating king pin with a baseplate, a second spherical joint moveably connects a first end of a pivot arm with the baseplate, and a third spherical joint moveably connects a second end of the floating king pin with a hanger, the pivot arm with a second end that is fixed within a hanger pivot arm recess, a pivot arm elastomeric component positioned between the hanger and the baseplate with a bore sized to receive and constrain the pivot arm, a floating kingpin elastomeric component positioned between the hanger and the baseplate with a bore sized to receive and constrain the floating kingpin, wherein the elastomeric components provide return to center force, suspension, and torque transfer, a virtual pivot point roll axis defined by a line between a virtual pivot point of the first truck and a virtual pivot point of the second truck, a longitudinal roll axis defined by a line between the centroid point of the first spherical joint and a centroid point of the second spherical joint of each truck, and three primary motions of leaning, steering, and floating, wherein when in use and with the wheels constrained by the ground leaning comprises a combination of rotations of the baseplate and deck assembly about the longitudinal roll axis and the virtual pivot point roll axis, steering comprises rotation of the hanger assembly around the hanger pivot axis, and floating comprises a range of motion defined by a range of motion of the first, second, and third spherical joints as constrained by the elastomeric components wherein the elastomeric components absorb torque to allow leaning without steering and steering without leaning.

11. The skateboard assembly of claim 10 wherein each truck comprises, the baseplate assembly/first rigid body further comprises: the baseplate, a top surface of the baseplate with a first hemispheric recess and second hemispheric recess, a bottom surface of the baseplate with a floating kingpin recess and a pivot arm recess where the floating kingpin recess is comprised of a flat surface and a lip, and the pivot arm recess is comprised of a flat surface and a lip, the hanger assembly/second rigid body further comprises:

the hanger with a horizontal member that connects with two laterally spaced axles where each axle connects with a wheel assembly, a top surface of the hanger with a floating kingpin recess and a pivot arm recess where the floating kingpin recess is comprised of a flat surface and a lip, and the pivot arm recess is comprised of a flat surface and a lip, the pivot arm with a first end and a second end where the second end of the pivot arm is positioned within and connected with the hanger pivot arm recess, a second hemispheric bearing with a bore for receiving the first end of the pivot arm and a pivot arm nut that secures the second hemispheric bearing to the pivot arm, a bottom surface of the hanger with a hanger hemispheric recess, a bore through the hanger within the hanger hemispheric recess for receiving the floating kingpin, the floating kingpin assembly/third rigid body further comprises:

a floating kingpin with the first end and a second end, a first hemispheric bearing with a bore that receives the first end of the floating king pin, and a floating kingpin nut that secures the first hemispheric bearing to the first end of the floating kingpin, a third hemispheric bearing connected with the second end of the floating kingpin, wherein the first hemispheric bearing mates with the first hemispheric recess in the top surface of the baseplate thereby defining the first spherical joint, the second hemispheric bearing mates with the second hemispheric recess in the top surface of the baseplate thereby defining the second spherical joint, and the third hemispheric bearing mates with the third hemispheric recess in the bottom surface of the hanger thereby defining the third spherical joint, the pivot arm elastomeric component further comprising:

a top surface, a bottom surface, an outside surface, and a bore sized to receive and constrain the pivot arm, the bottom surface of the pivot arm elastomeric component mates with the flat surface of the hanger pivot arm recess and a lower outside surface of the elastomeric component is constrained by the lip of the hanger pivot arm recess, the top surface of the pivot arm elastomeric component mates with the flat surface of the baseplate pivot arm recess and an upper outside surface of the elastomeric component is constrained by the lip of the baseplate pivot arm recess, the floating kingpin elastomeric component further comprising:

a top surface, a bottom surface, an outside surface, and a bore sized to receive and constrain the floating kingpin, the bottom surface of the floating kingpin elastomeric component mates with the flat surface of the hanger kingpin recess and a lower outside surface of the elastomeric component is constrained by the lip of the hanger kingpin recess, the top surface of the floating kingpin elastomeric component mates with the flat surface of the baseplate floating kingpin recess and an upper outside surface of the elastomeric component is constrained by the lip of the baseplate floating kingpin recess, wherein the elastomeric components absorb small amounts of torque to create floating, and wherein the elastomeric components provide full suspension.

12. The skateboard assembly of claim 11 wherein, the deck has integrated baseplate features comprising the baseplate floating kingpin recess, baseplate floating kingpin flat surface, and floating kingpin lip, and the baseplate pivot arm recess, the pivot arm flat surface, and pivot arm lip.

13. The skateboard assembly of claim 11 with unidirectional travel wherein, one truck is a front truck and one truck is a rear truck, wherein the hanger assembly of the front truck comprising a trailing offset of a front axle axis relative to a front hanger pivot axis, the hanger assembly of the rear truck comprising a trailing offset of a rear axle axis relative to a rear hanger pivot axis.

14. The skateboard assembly of claim 11 with bi-directional travel wherein, one truck is a first truck and one truck is a second truck, and the first truck is mounted on a front of the skateboard assembly and the second truck is mounted on a rear of the skateboard assembly, the first truck and the second truck are a matched pair.

* * * * *